US008596018B2

(12) United States Patent
Dagher et al.

(10) Patent No.: US 8,596,018 B2
(45) Date of Patent: Dec. 3, 2013

(54) BLAST MITIGATION AND BALLISTIC PROTECTION SYSTEM AND COMPONENTS THEREOF

(75) Inventors: Habib J. Dagher, Veazie, ME (US); Eric D. Cassidy, Easton, ME (US); Laurent R. Parent, Veazie, ME (US); Anthony J. Dumais, Windham, ME (US); Edwin N. Nagy, Orono, ME (US); Robert T. O'Neil, Orono, ME (US); Richard F. Nye, Old Town, ME (US)

(73) Assignee: University of Maine System Board of Trustees, Bangor, ME (US)

( * ) Notice: Subject to any disclaimer, the term of this patent is extended or adjusted under 35 U.S.C. 154(b) by 1232 days.

(21) Appl. No.: 12/244,407

(22) Filed: Oct. 2, 2008

(65) Prior Publication Data

US 2012/0180633 A1 Jul. 19, 2012

Related U.S. Application Data

(63) Continuation-in-part of application No. 11/699,872, filed on Jan. 30, 2007.

(60) Provisional application No. 60/765,109, filed on Feb. 3, 2006, provisional application No. 60/765,546, filed on Feb. 6, 2006, provisional application No. 60/997,346, filed on Oct. 2, 2007, provisional application No. 61/128,325, filed on May 21, 2008.

(51) Int. Cl.
*E04B 1/38* (2006.01)

(52) U.S. Cl.
USPC ..... 52/704; 52/63; 52/222

(58) Field of Classification Search
USPC ..... 52/63, 222, 704; 135/97
See application file for complete search history.

(56) References Cited

U.S. PATENT DOCUMENTS

| | | | | |
|---|---|---|---|---|
| 4,079,161 | A | 3/1978 | Kile | |
| 4,404,889 | A | 9/1983 | Miguel | |
| 4,822,657 | A | 4/1989 | Simpson | |
| 4,830,245 | A | 5/1989 | Arakaki | |
| 5,470,631 | A | 11/1995 | Lindquist | |
| 5,720,403 | A | 2/1998 | Sawyer | |
| 6,568,310 | B2 * | 5/2003 | Morgan | 89/36.02 |
| 6,581,505 | B1 | 6/2003 | Levell | |
| 6,699,575 | B1 * | 3/2004 | Dagher et al. | 428/292.4 |
| 7,562,508 | B2 * | 7/2009 | Dickinson et al. | 52/793.1 |

(Continued)

FOREIGN PATENT DOCUMENTS

| | | | |
|---|---|---|---|
| CN | 2416480 | Y | 1/2001 |
| EP | 0024713 | A2 | 3/1981 |
| EP | 1469144 | A2 | 10/2004 |
| WO | 03086748 | A1 | 10/2003 |

OTHER PUBLICATIONS

International Search Report for Application No. PCT/US2008/078557, date of mailing: Dec. 3, 2008.

(Continued)

*Primary Examiner* — Branon Painter
(74) *Attorney, Agent, or Firm* — MacMillan, Sobanski & Todd, LLC

(57) ABSTRACT

A blast resistant coated wood member includes a wood member having a compression side and a tension side. A coating layer of fiber reinforced polymer (FRP) is adhered to the tension side of the wood member.

5 Claims, 13 Drawing Sheets

(56) References Cited

U.S. PATENT DOCUMENTS

| | | | | |
|---|---|---|---|---|
| 2003/0154679 | A1* | 8/2003 | Swiszcz et al. | 52/506.07 |
| 2004/0191441 | A1* | 9/2004 | Bureau et al. | 428/34.6 |
| 2005/0144900 | A1 | 7/2005 | Hallissy et al. | |
| 2007/0125042 | A1* | 6/2007 | Hughes et al. | 52/782.1 |
| 2007/0180982 | A1 | 8/2007 | Dagher et al. | |
| 2007/0293107 | A1* | 12/2007 | Follo et al. | 442/134 |

OTHER PUBLICATIONS

Chinese Search Report Communication, Application No. 200780008810.X, Date Feb. 2, 2007.

European Patent Office Supplementary European Search Report, Application No. EP07808978.6, Dated Apr. 11, 2012.

* cited by examiner

BLAST MITIGATION AND BALLISTIC PROTECTION SYSTEM AND COMPONENTS THEREOF

CROSS REFERENCE TO RELATED APPLICATIONS

This application is a continuation-in-part of U.S. patent application Ser. No. 11/699,872, filed Jan. 30, 2007, which claimed the benefit of U.S. Provisional Application No. 60/765,109, filed Feb. 3, 2006 and U.S. Provisional Application No. 60/765,546 filed Feb. 6, 2006. This application also claims the benefit of U.S. Provisional Application No. 60/997,346 filed Oct. 2, 2007, and U.S. Provisional Application No. 61/128,325 filed May 21, 2008, the disclosures of all of which are incorporated herein by reference.

Inventors: Habib J. Dagher, Eric D. Cassidy, Laurent R. Parent, Anthony J. Dumais, Edwin N. Nagy, Robert T. O'Neil, and Richard F. Nye.

This invention was made with government support under U.S. Army Engineer Research and Development Center Contract Nos. W912HZ-05-C-0058, W912HZ-06-2-0004, and W912HZ-07-2-0013, and U.S. Army Natick Soldier Research Development & Engineering Center Contract No. W911QY-05-C-0043. The government has certain rights in this invention.

BACKGROUND

Various embodiments of a blast mitigation and ballistic protection system are described herein. In particular, the embodiments described herein relate to an improved system for blast mitigation and ballistic protection system and improved components for such systems.

Protective armor typically is designed for several applications types: personal protection such as helmets and vests, vehicle protection such as for high mobility multi-wheeled vehicles (HMMWVs), and rigid structures such as buildings. Important design objectives for personal protection include, for example, protection against ballistic projectiles, low weight, and good flexure. Vehicles and rigid structures often require superior ballistic and blast protection and low cost per unit area.

Blast protection typically requires the material to have the structural integrity to withstand the high loads of blast pressure. Ballistic protection typically requires the material to stop the progress of bomb fragments ranging in size from less than one millimeter to 10 mm or more and traveling at velocities in excess of 2000 meters per second for smaller fragments.

Accordingly, personal protective armor is often made of low weight, high tech materials having a high cost per unit area. High unit area cost may be acceptable to the user because people present low surface area relative to vehicles and buildings. The materials used in personal protective armor products do not need high load bearing capabilities because either the body supports the material, such as in a vest, or the unsupported area is very small, such as in a helmet.

As a result of the blast, ballistic, and low unit area cost requirements for vehicles and structures, the materials used in blast protection are typically heavier materials, including for example, metals and ceramics. Such materials may not always be low cost. Such materials may further be of usually high weight per unit area.

It is also desirable to improve the energy absorption capacity of wood and wood composites components, subassemblies, and structures. A common wood frame construction method uses wood or steel studs, and wood or steel framing with plywood, Oriented Strand Board (OSB) sheathing panels, or stucco sheathing. The framing/sheathing combination forms shear walls and horizontal diaphragms which resist horizontal and vertical loads applied to the structure. This form of construction is used in the majority of single family homes in the United States, as well as a significant portion of multi-family, commercial, and industrial facilities. The resistance of conventional light-frame wood buildings to extreme events such as air blast from explosive weapons or hurricane winds depends in large part on the energy absorbing characteristics of the framing members and connections therebetween. It is desirable to improve the energy absorbing characteristics of wood structures.

International Organization for Standardization (ISO) containers are commonly used to house soldiers, disaster relief workers, contractors, and others where temporary and rapidly deployable shelters are used. Additionally, containers are used for mobile medical units, control and command centers, communications, equipment storage, and the like. Many of these applications are located in areas exposed to threats such as car bombs, mortars, improvised explosive devices (IEDs), small arms fire, etc. Containers converted for these applications typically do not have systems for blast and fragmentation mitigation.

Field housing for the military is vulnerable to forces encountered during the blast wave of bomb explosions. The forces generated during explosions are capable of fracturing and dislodging framing components. The resulting airborne debris presents a danger to troops within the confines of a building as well as to troops in adjacent buildings and surrounding areas. Therefore, a connector is required to minimize the lethal force of dislodged framing material.

SUMMARY

The present application describes various embodiments of a blast mitigation and ballistic protection system and improved components for such systems. One embodiment of a blast resistant coated wood member includes a wood member having a compression side and a tension side. A coating layer of fiber reinforced polymer (FRP) is adhered to the tension side of the wood member.

In another embodiment, a blast and ballistic protective wall panel assembly includes a first panel member defines an interior wall member and has two major faces. An interior major face defines a tension side of the first panel and an exterior major face defines a compression side of the first panel. At least the tension side of the first panel member is substantially covered by fiber reinforced polymer (FRP). A structural frame member has a substantially rectangular cross-section with a compression side, a tension side, and two lateral sides. At least the tension side of the structural frame member is substantially covered by FRP. The tension side is further connected to the compression side of the first panel member. A second composite panel member defines an exterior wall member and includes a first composite layer, a second composite layer, and a core disposed between the first and second composite layer. The core is formed from one of wood and a wood product. An encapsulation layer covers all exposed surfaces of the protective composite panel. The second composite panel member is connected to the compression side of the structural frame member.

In another embodiment, a blast and ballistic protective wall panel assembly includes a plurality of panel members, each having two major faces. An interior major face defines a tension side of the first panel, and an exterior major face defines a compression side of the first panel. At least the tension side of the first panel member is substantially covered by fiber reinforced polymer (FRP). A structural frame member has a substantially rectangular cross-section with a compression side, a tension side, and two lateral sides. At least the tension side of the structural frame member is substantially covered by FRP. The tension side of the structural frame member is connected to the compression side of a first one of the panel members. The compression side of the structural frame member is connected to the tension side of a second one of the panel members, thereby defining a blast and ballistic protective wall panel assembly.

In an additional embodiment, a connector connects a first dimensional wood member to a second dimensional wood member. The connector includes a first body portion and has a leg extending substantially 90 degrees in a first direction from the first body portion. A second body portion extends substantially 90 degrees in a second direction from the first body portion. The second body portion has a first leg extending substantially 90 degrees in a third direction from the second body portion.

Other advantages of the blast mitigation and ballistic protection system and components thereof will become apparent to those skilled in the art from the following detailed description, when read in light of the accompanying drawings.

DETAILED DESCRIPTION

Members of the military or other persons located in combat or hostile fire areas may work or sleep in temporary or semi-permanent structures that require protection from blast and/or from ballistic projectiles. Examples of such structures include tents, South East Asia huts (SEAHUTS), and containerized housing units (CHU). It will be understood that other types of temporary, semi-permanent, or permanent structures may require protection from blast and/or from ballistic projectiles.

Like personal protective armor, but unlike protective armor provided for vehicles and permanent structures, the weight of such protection is an important consideration for two reasons. First, the material in panel form should be light enough to be moved and installed by persons, such as members of the military, without lifting equipment. Second, the panels should be light enough so as not to overstress the tent frame either statically or dynamically. Desirably, blast and ballistic protection for temporary or semi-permanent structures will have a low unit area cost because the surface area to be covered of such temporary or semi-permanent structures is large. Additionally, the ballistic protection must have sufficient structural integrity to withstand blast forces over a relative long span, because many such temporary or semi-permanent structures have widely spaced support or framing members.

Figure 1:
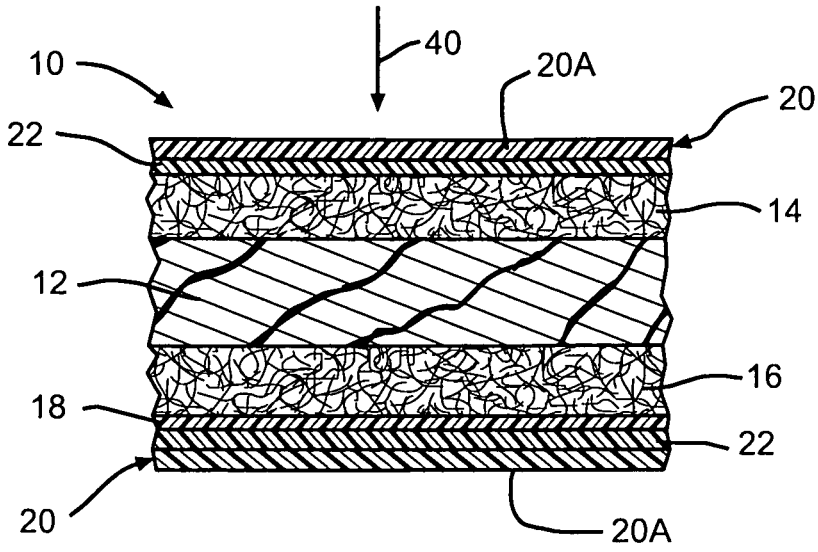
FIG. 1 is a schematic cross-sectional view of a first embodiment of the protective composite panel.

Referring now to FIG. 1, there is illustrated generally at 10 a schematic view of a first embodiment of a protective composite panel. The illustrated composite panel 10 includes a core 12, a first composite layer or strike face 14, a second composite layer or back face 16, a backing layer 18, and an outer layer or encapsulation layer 20, each of which will be described in detail below.

The core 12 may be formed from wood or a wood product, such as for example, oriented strand board (OSB), balsa, plywood, and any other desired wood or wood product. Additionally, the core 12 may be formed from plastic or any other desired non-wood material. For example, the core 12 may be formed as a honeycomb core made of thermoplastic resin, thermosetting resin, or any other desired plastic material. In the illustrated embodiment, the core 12 is within the range of from about ⅛ inch to about ⅜ inch thick. Alternatively, the core 12 may be any other desired thickness.

The strike face 14 may comprise one or more layers of high-performance fibers and thermoplastic resins chosen for durability, level of protection, to reduce manufacturing costs, and to enhance adhesion between the core 12 and the strike face 14. The strike face 14 may include glass fibers, including for example, glass fibers and woven or unwoven glass mats. For example, the strike face 14 may include E-glass fibers, S-glass fibers, woven aramid fiber such as K760 formed from KEVLAR®, (an aramid synthetic fiber), or a KEVLAR® fabric such as HEXFORM®, such as K760 or HEXFORM®, a material manufactured by Hexcel Corporation of Connecticut, non-woven KEVLAR® fabric, such as manufactured by Polystrand Corporation of Colorado, and any other material having desired protection from ballistic projectile fragment penetration. The strike face 14 may also include any combination of E-glass fibers, S-glass fibers, woven KEVLAR® fibers, and non-woven KEVLAR® fibers. It will be understood that any other suitable glass and non-glass fibers may also be used.

The strike face 14 may also include thermoplastic resin, such as for example, polypropylene (PP), polyethylene (PE), and the like. If desired, the strike face 14 may be formed with additives, such as for example ultra-violet inhibitors to increase durability, fire inhibitors, and any other desired performance or durability enhancing additive. Advantageously, use of thermoplastic resin at the interface between the wood-based core 12 and either or both of the strike face 14 and the back face 16 promotes adhesion between the core 12 and the faces 14 and 16.

In a first embodiment of the strike face 14, the strike face 14 may be formed from dry glass fibers disposed on and/or between one or more layers of thermoplastic resin sheet or thermoplastic resin film. In such an embodiment, the fibers and resin may be heated to bond the fiber with the resin.

In a second embodiment of the strike face 14, one or more sheets of glass fiber with thermoplastic resin encapsulated or intermingled therewith, may be provided.

The back face 16 may be substantially identical to the strike face 14, and will not be separately described.

The backing layer 18 may be formed from material which provides additional protection from both blast and ballistic projectile fragment penetration, such as for example, material formed of an aramid fiber. In a first embodiment of the backing layer 18, the layer 18 is formed from a sheet or film of KEVLAR®. In a second embodiment of the backing layer 18, the layer 18 is formed from non-woven KEVLAR® fibers. In a third embodiment of the backing layer 18, the layer 18 may be formed from woven KEVLAR® fibers, such as K760 and HEXFORM®. In a fourth embodiment of the backing layer 18, the layer 18 may be formed from a sheet or film of any other material having desired protection from ballistic projectile fragment penetration.

Figure 2:
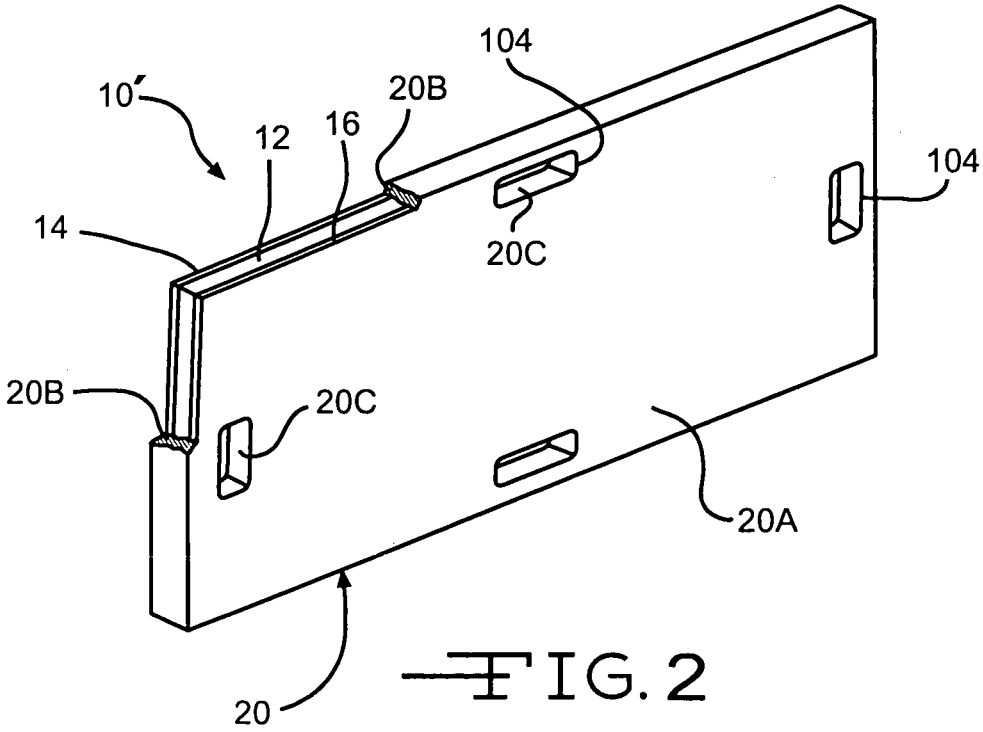
FIG. 2 is a perspective view of a second embodiment of the protective composite panel illustrated in FIG. 1.

Referring now to FIG. 2, there is illustrated generally at 10' a perspective view of a second embodiment of a protective composite panel. The illustrated composite panel 10' includes an outer or encapsulation layer 20 which encapsulates the strike face 14, core 12, back face 16, and backing layer 18. The illustrated encapsulation layer 20 is formed from polypropylene. Alternatively, the encapsulation layer 20 may be formed from any other material, such as for example, any material compatible with the thermoplastic resin of the strike face 14 and back face 16. Such an encapsulation layer 20 protects the strike face 14, core 12, back face 16, and backing layer 18 from the negative effects of the environment, such as excess moisture. The illustrated composite panel 10' includes a plurality of slots or carrying handles 104, which will be described in detail below.

The illustrated encapsulation layer 20 includes a first portion 20A disposed on the broad faces of the composite panel 10'. In the illustrated embodiment, the first portion 20A of the encapsulation layer 20 is within the range of from about 0.002 inch to about 0.010 inch thick. It will be understood that the first portion 20A of the encapsulation layer 20 may have any other desired thickness. The illustrated encapsulation layer 20 includes a second portion 20B disposed about the peripheral edge of the composite panel 10'. In the illustrated embodiment, the second portion 20B of the encapsulation layer 20 is within the range of from about ⅛ inch to about ½ inch thick. It will be understood that the second portion 20B of the encapsulation layer 20 may have any other desired thickness. The encapsulation layer 20 may also include a third portion 20C disposed on the inner surfaces of the slots 104.

If desired, the composite panel 10' may be provided with a fiber layer 22 between the back face 16 and/or backing layer 18 and the encapsulation layer 20, and between the strike face 14 and the encapsulation layer 20. The fiber layer 22 illustrated in FIG. 1 is a layer of non-woven polyester fibers having a weight within the range of from about ¼ once per square yard (oz/yd$^2$) to about 1½ oz/yd$^2$. The fiber layer 22 may be formed from any other materials, such as for example, any fibers having a melting point above the melting point of the polypropylene encapsulation layer 20 or other encapsulation layer material, and may have any other desired weight.

Figures 9, 10:
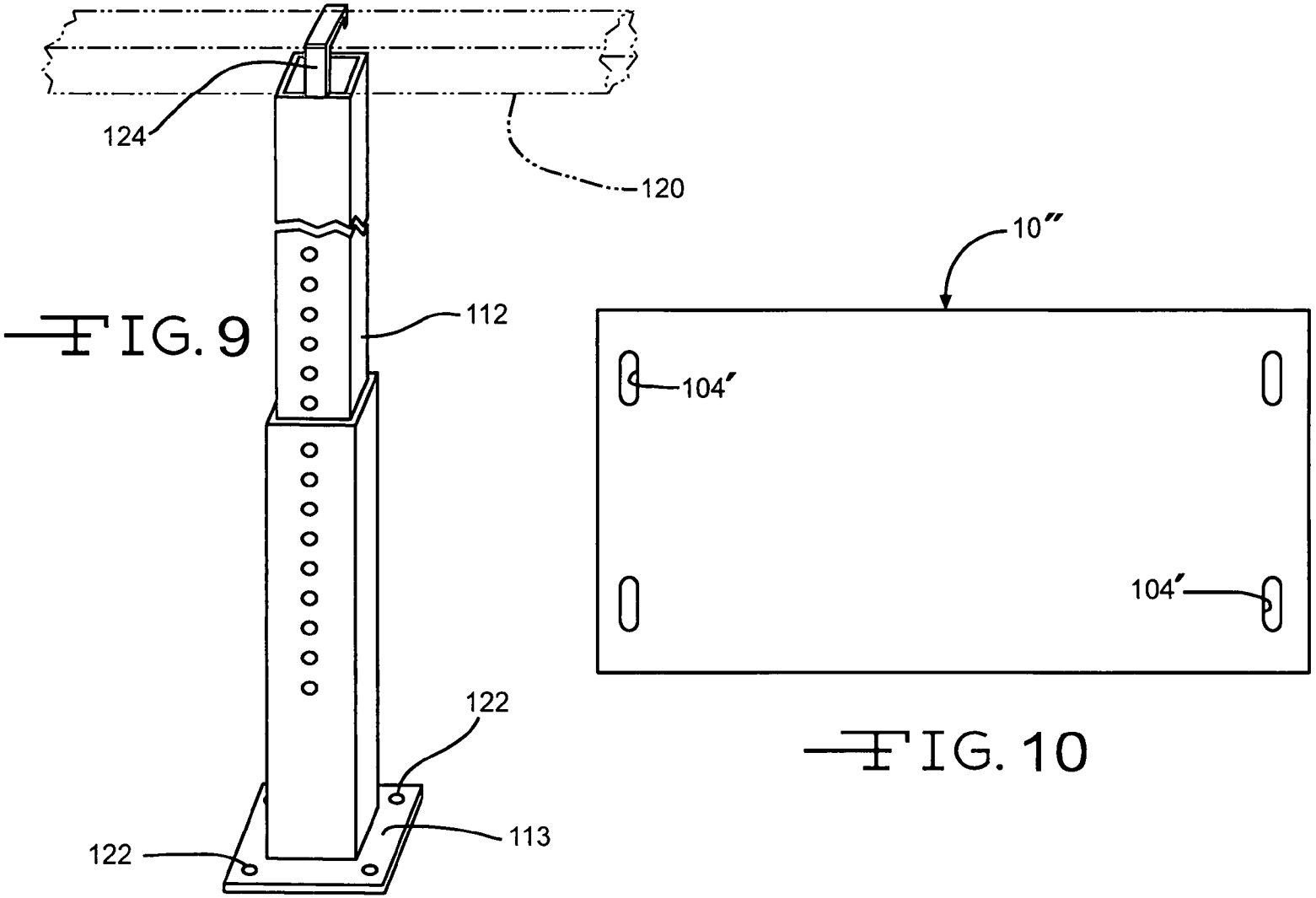
FIG. 9 is a perspective view of a supplementary vertical member for a tent.
FIG. 10 is a schematic front view of a third embodiment of the protective composite panel illustrated in FIGS. 1 and 2.

Referring now to FIG. 10, there is illustrated generally at 10" a schematic front view of a third embodiment of a protective composite panel. The illustrated composite panel 10" is substantially identical to the protective composite panel 10', and includes an alternate arrangement of the carrying handles 104'.

In a first embodiment of the process of manufacturing the protective composite panel 10, the strike face 14, the core 12, the back face 16, and backing layer 18 may be arranged in layers adjacent one another and pressed and heated to melt the thermoplastic resin in the faces 12, 16, the heated resin thereby bonding the faces 12, 16 to the core 12, and bonding the backing layer 18 to the face 16. The press may provide within the range of from about 50 psi to about 150 psi of pressure and within the range of from about 300 degrees F. to about 400 degrees F. of heat to the layers.

If desired, the layers of material (i.e. the layers defining the strike face 14, the core 12, the back face 16, and backing layer 18) may be fed from continuous rolls or the like, and through a continuous press to form a continuous panel. Such a continuous panel may be then be cut to any desired length and/or width.

If desired, the strike face 14, the core 12, the back face 16, and backing layer 18 may be pre-cut to a desired size, such as for example 4 ft×8 ft, and pressed under heat and pressure as described above, to form the composite panel 10. Alternatively, the composite panel 10 may be formed without the backing layer 18, and/or without the core 12.

When forming a relatively thin composite panel 10, such as for example a panel having a thickness less than about ¼ inch, the core 12 and face layers 14 and 16 may be fed into a press, heated and compacted within the press under pressure to form the composite panel 10, and cooled as it is removed from the press.

When forming a relatively thicker composite panel 10, such as for example a panel having a thickness greater than about ⅝ inch, the face layers 14 and 16 may be first preheated. The core 12 and face layers 14 and 16 may then be fed into a press, further heated and compacted within the press under pressure to form the composite panel 10, and cooled as it is removed from the press. Composite panels 10 having a thickness within the range of from about ¼ inch to about ⅝ inch may be treated as either relatively thin or relatively thicker composite panels 10, depending on the specific heat transfer properties of the panel. It will be understood that one skilled in the art will be able to determine the desired forming method for composite panels 10 having a thickness within the range of from about ¼ inch to about ⅝ inch through routine experimentation.

When forming the encapsulated composite panel 10', the pressed panel 10' may be placed into a press with the first portion 20A and the second portion 20B of the encapsulation layer 20, and heated and compacted within the press under pressure to form the encapsulated composite panel 10', and cooled as it is removed from the press.

Table 1 lists 24 alternate embodiments of strike face 14, core 12, back face 16, and backing layer material combinations, each of which define a distinct embodiment of the composite panel 10. The composite panel 10 may be formed with any desired combination of layers. Composite panels 10, such as the exemplary panels listed in table 1, combine the unique properties of each component layer to meet both ballistic and structural blast performance requirements, as may be desired by a user of the panel. It will be understood that any other desired combination of strike face 14, core 12, back face 16, and backing layer materials may also be used. Table 1 further lists the areal density (in pounds/foot) for each embodiment of the composite panel 10. As used herein, areal density is defined as the mass of the composite panel 10 per unit area.

For example, one embodiment of the panel 10 may be formed from one or more layers of S-glass (with thermoplastic resin), a layer of balsa, one or more layers of S-Glass (with thermoplastic resin), and a layer of aramid, such as KEVLAR®.

Another embodiment of the panel 10 may be formed, in order, from one or more layers of E-glass (with thermoplastic resin), a layer of OSB, and one or more layers of E-Glass (with thermoplastic resin).

Another embodiment of the panel 10 may be formed, in order, from a layer of E-glass and a layer of S-glass (with thermoplastic resin), a layer of either OSB, balsa, or plywood, and a layer of E-glass and a layer of S-glass (with thermoplastic resin).

Another embodiment of the panel 10 may be formed, in order, from a layer of E-glass and a layer of S-glass (with thermoplastic resin), a layer of either OSB, balsa, or plywood, a layer of E-glass and a layer of S-glass (with thermoplastic resin), and a layer of aramid, such as KEVLAR®.

Another embodiment of the panel 10 may be formed, in order, from one or more layers of S-glass (with thermoplastic resin), a layer of balsa, and one or more layers of S-Glass (with thermoplastic resin).

It will be understood that protective panels having an aramid backing layer, such as KEVLAR®, may be formed having a lower optimal weight relative to similarly performing panels formed without an aramid backing layer. It will be further understood that protective panels without an aramid backing layer may be formed having a lower cost relative to the cost of similarly performing panels having an aramid layer.

It will be understood that protective panels 10 may be formed having material layer compositions different from the exemplary panels described in table 1, or described herein above.

One advantage of the embodiments of each composite panel 10 listed in table 1 meet the level of ballistic performance defined in National Institute of Justice (NIJ) Standard 010104. Another advantage of the embodiments of each composite panel 10 listed in table 1 is that each panel can withstand and provide protection from close proximity blast forces, such as blast forces equivalent to the blast (as indicated by the arrow 40) from a mortar within close proximity to the panel 10.

Another advantage is that the thermoplastic resins, such as PP and PE, used to form the strike face 14 and the back face 16 have been shown to reduce manufacturing costs relative to panels formed using thermosetting-based composites in the faces 14 and 16.

Another advantage is that the use of higher thermoplastic resin content at the interface between the faces 14 and 16 and the core 12 has been shown to promote enhanced adhesion of the faces 14 and 16 to the core 12.

Another advantage is that the use of UV inhibitors in the resin has been shown to increase durability of the panel 10.

Another advantage of the panels 10 listed in table 1 is that most of the 24 embodiments listed have an areal density of within the range of about 2.0 psf to about 4.25 psf, and the cost to manufacture the panels 10 is lower relative to the manufacturing costs typically associated with manufacturing known composite panels.

Another advantage of the panels 10 listed in table 1 is that they meet the flammability standards described in the American Society for Testing and Materials (ASTM) standard ASTM E 1925.

TABLE 1

| Embodiment No. | Composite Panel Composition (Alternate Embodiments) | Areal Density (psf) |
|---|---|---|
| 1. | $E_{11}/O/E_{11}$ | 4.22 |
| 2. | $E_{11}/B/E_{11}$ | 3.54 |
| 3. | $E_{10}/O/E_{10}$ | 3.92 |
| 4. | $E_{10}/B/E_{10}$ | 3.24 |
| 5. | $S_9/B/S_9$ | 2.51 |
| 6. | $S_9/B/S_6/H_2$ | 2.34 |
| 7. | $E_{20}$ | 2.96 |
| 8. | $S_8/B/S_8$ | 2.37 |
| 9. | $E_5/S_5/B/E_5/S_5$ | 3.00 |
| 10. | $E_5/S_5/B/E_4/S_2/H_2$ | 2.72 |
| 11. | $E_1/S_1/E_1/S_1/E_1/H_1/E_1/H_1$ | 2.72 |
| 12. | $E_{11}/B/E_{10}/H_1$ | 3.54 |
| 13. | $E_{11}/O/E_{10}$ | 4.05 |
| 14. | $S_9/B/S_6/K760_2$ | 2.48 |
| 15. | $K760_1/S_9/B/S_6/K760_2$ | 2.58 |
| 16. | $E_6/B/E_1/H_{10}$ | 2.37 |
| 17. | $E_6/B/E_1/K760_{10}$ | 2.32 |
| 18. | $K760_5/E_6/B/E_1/K760_{10}$ | 2.32 |
| 19. | $E_6/B/E_1/KP_{10}$ | 2.20 |
| 20. | $E_6/B/E_1/K760_{13}$ | 2.61 |
| 21. | $E_9/B/E_1/KP_{11}$ | 2.65 |
| 22. | $E_7/B/E_1/KP_5/E_1/B/E_1/KP_6$ | 3.18 |
| 23. | $E_{10}/B/E_1/KP_5/E_1/B/E_1/KP_{10}$ | 4.02 |
| 24. | $E_5/B/S_5/B/S_5$ | 3.96 |

key: subscript denotes the number of layers of material.
B ¼ in balsa wood
E E glass
H HEXFORM ®
K K760
KP KEVLAR ® Poly
O ¼ in OSB
S S glass The various embodiments of the panel 10 as described herein may be used in any desired application, such as for example in tents, SEAHUTS, residential and commercial construction, other military and law enforcement applications, and recreational applications. For example, the panels 10 may be used in lieu of plywood or OSB when constructing SEAHUTS or other residential and commercial buildings requiring enhanced protection from blasts and ballistic projectiles.

Figures 3, 3A:
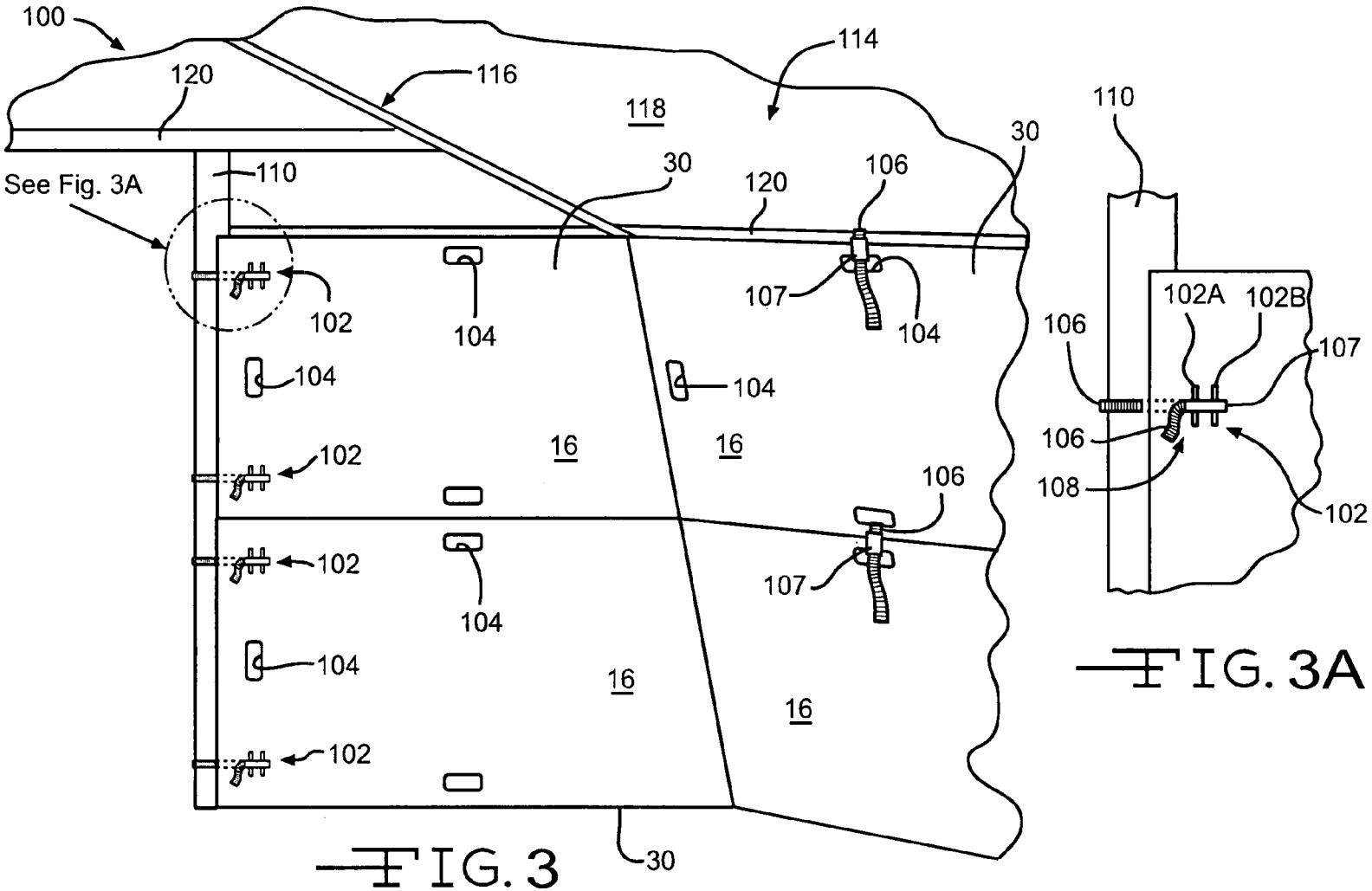
FIG. 3 is a schematic illustration of an interior of a tent having a plurality of a third embodiment of the protective composite panels illustrated in FIGS. 1 and 2.
Figure 4:
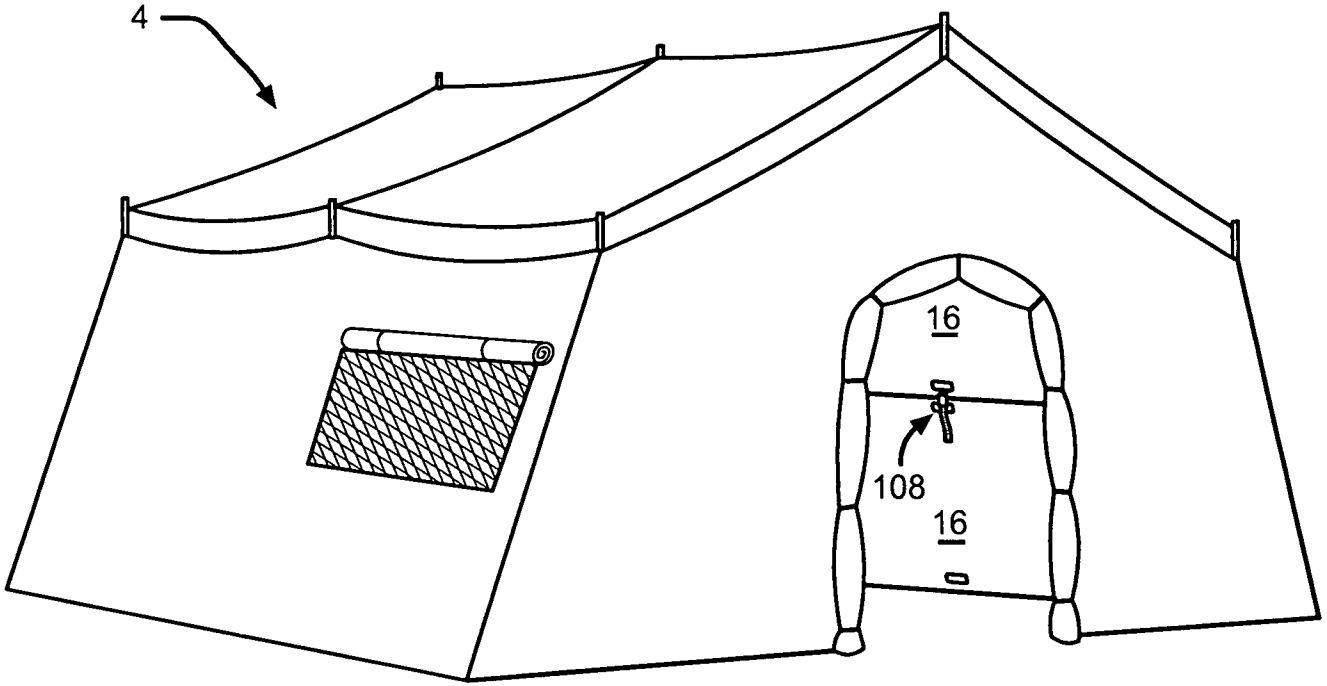
FIG. 4 a schematic illustration of the exterior of the tent illustrated in FIG. 3.
Figure 6:
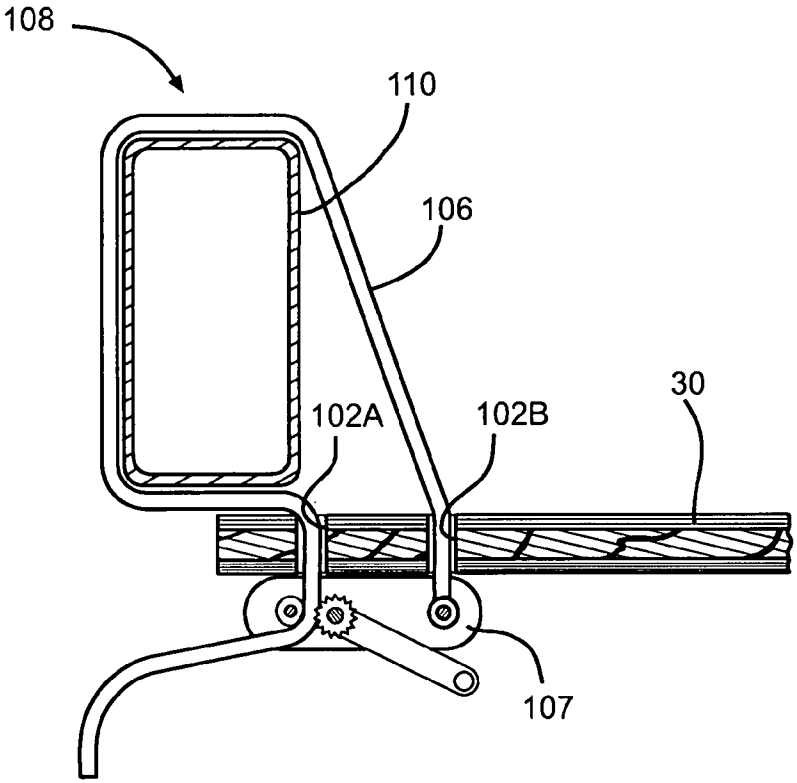
FIG. 6 is a schematic top view of a first embodiment of the connection system illustrated in FIGS. 3 and 3A.

Referring now to FIG. 3, there is illustrated generally at 100, a first embodiment of tent ballistic protection system. The illustrated system 100 includes a plurality of composite panels, such as the panels 30, described herein. The panels 30 may be provided in any size and shape, such as the size and shape of the vertical walls of a tent 114 having a frame 116, as best shown in FIG. 4.

The panels 30 may include a plurality of attachment slots 102. In the embodiment illustrated in FIGS. 3 and 5, the slots 102 are formed as pairs of slots 102A and 102B. The illustrated slots 102A and 102B are formed adjacent a peripheral edge of the panel 30. It will be understood that any desired number of slots 102 may be provided, such as for example one slot, three slots, or more than three slots. The slots 102A and 102B may be of any desired length and width. In the illustrated embodiment, the slots 102A and 102B have a length long enough to receive a plurality of strap 106 sizes, as will be described in detail herein. Likewise, the slots 102A and 102B have width wide enough to receive straps 106 having a plurality of thicknesses. Alternatively, the second and third embodiments of the attachment slot, 104 and 104', respectively, may also be provided in the panel 10, 10', 10", and 30 in any desired number and any desired location in the panel 10, 10', 10", and 30. In the illustrated embodiment, the slot 104 may also function as a carrying handle for the panel 30.

In the exemplary embodiment illustrated, a strap, such as a tie-down strap 106, is also provided. The illustrated strap 106 is a nylon web strap with cam-buckle 107. It will be understood however, that any other suitable strap or tie-down device may be used, such as for example, straps with hook and loop type fasteners, straps with couplings such as those commonly used by rock climbers, or plastic locking tie-straps.

Figure 5:
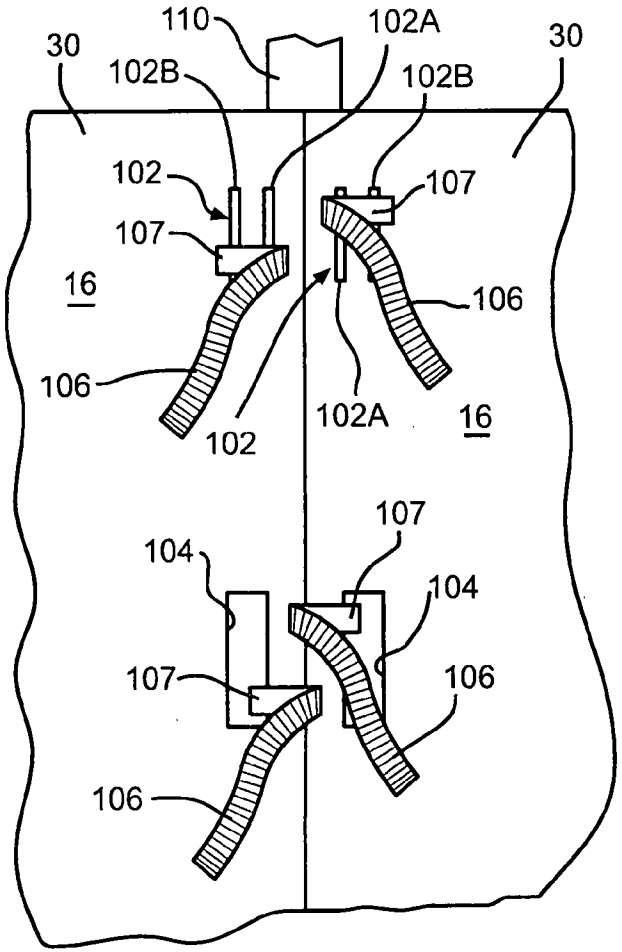
FIG. 5 is an enlarged schematic view of the interior of the tent illustrated in FIG. 3

As best shown in FIGS. 3 and 5, the slots 102A and 102B of the panel 30 and the strap 106 cooperate to define a connection system 108. In the exemplary embodiment illustrated, the system 108 further includes a supplementary vertical member 112, which will be described in detail below. In operation, and as best shown in FIGS. 3 and 5, the straps 106 may be inserted through the slot 102A, around any vertical frame member 110 of the tent 114, through the slot 102B and into a strap fastening mechanism, such as the buckle 107. The strap 106 may then be tightened, thereby causing the panel 30 to snugly engage the vertical frame member 110 of the tent frame 116. Adjacent panels 30 may be similarly attached to any desired vertical member 110, as best shown in FIG. 5. As used herein, vertical is defined as substantially perpendicular to the ground or other surface upon which the tent 114 is erected.

If desired, the panel 30 may be attached adjacent a roof panel 118 of the tent 114. For example, the strap 106 may be inserted through the slot 104 and around a horizontal frame member or cross-beam 120, as shown in FIG. 3.

By using the connection system 108, the panels 30 may be rapidly attached to an existing tent frame 116. The panels 30 may further be attached to the existing tent frame 116 without the need for additional tools. It will be understood however, that the straps 106 of the connection system 108 may also be rapidly decoupled or detached from the tent frame 116 without the need for additional tools.

Figure 8:
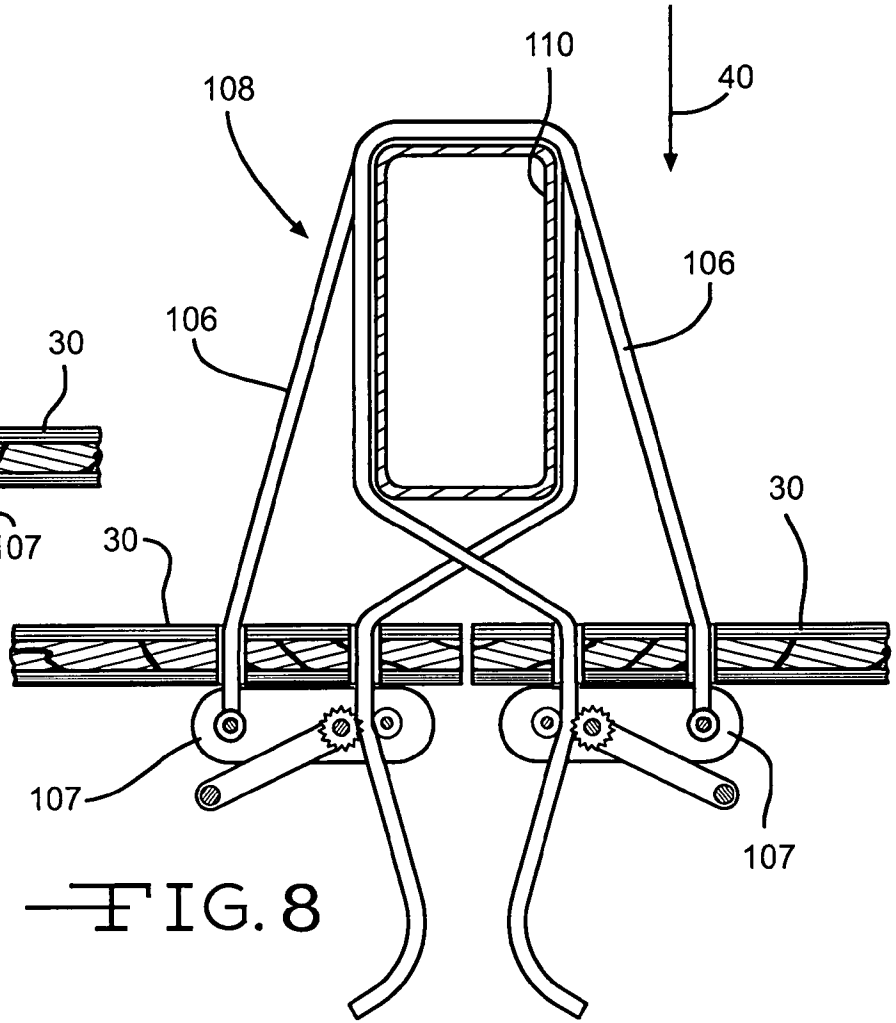
FIG. 8 is a schematic top view of the connection system illustrated in FIG. 7, shown during application of a blast force.
Figure 7:
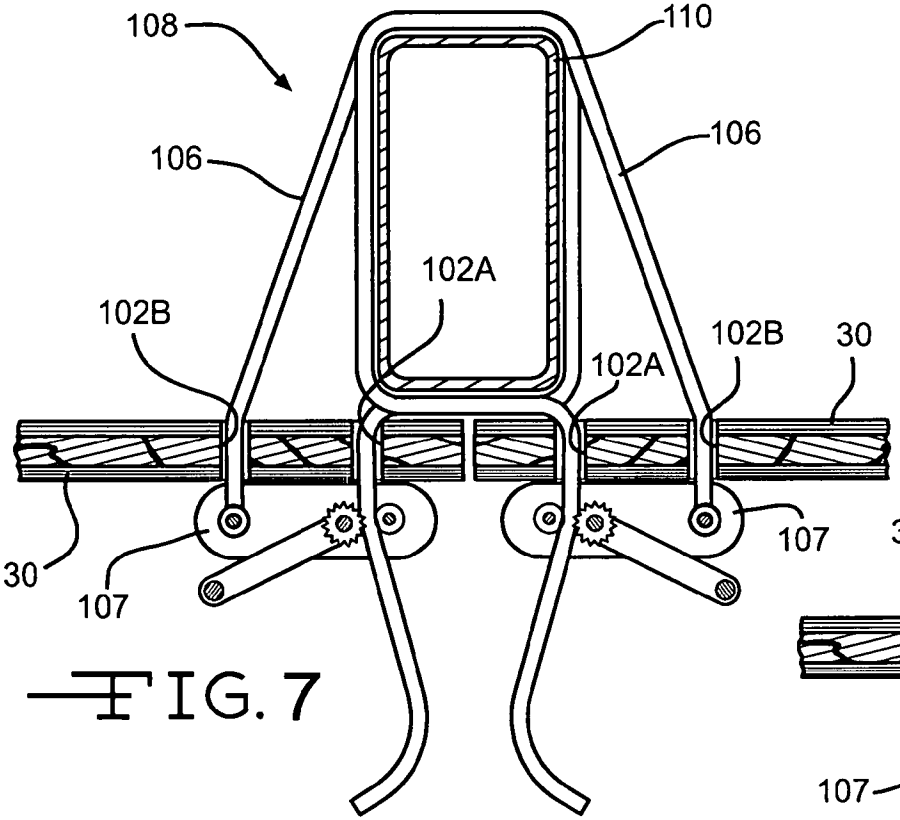
FIG. 7 is a schematic top view of a second embodiment of the connection system illustrated in FIG. 5.

Advantageously, the connection system 108, has been shown to reduce localized blast stresses on the panels 30. As best shown in FIGS. 3 and 5 through 7, the connection system 108 having two slots 102A and 102B, allows the panels 30 to be tightened to be snug to the tent frame 116. The system 108 further allows for movement during a dynamic blast loading event. For example, in the exemplary embodiment illustrated, the straps 106 are tightened to connect the panels 30 to the vertical members 110 of the tent frame 116, as shown in 3 and 5 through 7. Such a system 108, when assembled as described herein, allows adjacent panels 30 to pull away from the vertical member 110 to which the panels 30 are attached, as the straps 106 yield in response to a blast load, as indicated by the arrow 40. During and in response to such a blast load, the straps 106 of adjacent panels 30 extend inwardly and form a substantially 'X' shape when viewed from above, as shown in FIG. 8. By responding to a blast load as described herein, the system 108 increases the period, or vibration response, of the panels 30, and frame to which they are attached, and further reduces the blast pressure on the panels 30 and frame to which they are attached by within the range of from about 50 percent to about 20 percent of the blast pressure applied. The system 108 further reduces the membrane forces, or blast pressure, on the tent frame 116.

A tent or plurality of tents, such as the tent 114 illustrated in FIG. 4, may have an insufficient number of vertical members 110 from which to attach the panels 30, such as near a doorway of the tent 114. In such a situation, a supplementary vertical elongated member, such as illustrated at 112 in FIG. 9, may be provided as a component of the connection system 108. The vertical member 112 may include a base plate 113 at a lower end 112A thereof. The base plate 113 may include one or more holes 122 for receiving pins or stakes for securing the member 112 to the ground. An upper end 112B of the member 112 may include a hook, such as for example, a substantially 'U' shaped hook 124 for attaching the member 112 to a horizontal cross-beam, such as the cross-beam 120. One or more persons may simply lift the member 112 to engage the hook 124 with the horizontal cross-beam 120, thereby allowing attachment of the member 112 without tools, without a ladder, and without altering or modifying the tent frame 116.

The panels may be manufactured in any desired length and width, and may therefore be manufactured to accommodate any size tent and tent frame 116.

In the illustrated embodiment, the panels are installed inside the tent 114, i.e. under the tent fabric, so as not to be visible to the enemy in a combat environment. Placement within the tent further protects the panels 30 from potential environmental damage (i.e. from moisture, and UV radiation), thereby increasing durability.

One advantage of the composite panels 30 illustrated in FIGS. 2, 3, and 5, is that the combination of the attachment slots 102 and/or 104 formed near the peripheral edge of each composite panel 30, and the straps 106 allow for rapid attachment of the panels 30 to an existing tent frame 116, such as for example within about 30 minutes by four people. Additionally, the panels 30 are light enough to be carried by four persons, such as for example four women in the fifth percentile for human physical characteristics as discussed in MIL-STD-1472F, 1999.

Another advantage of the illustrated composite panels 30 is that the panels 30 can span a typical distance, such as 8 ft, between vertical tent frame members 110 without requiring intermediate or supplemental vertical support.

Another advantage is that in locations where multiple tents 114 are erected in close proximity to one another, the tents 114 can be arranged such that the composite panels 30 in one tent 114 provide additional ballistic and blast protection to occupants in adjacent tents 114.

It will be understood that the panels 10, 10', and 30 can be used in other types of temporary, semi-permanent, or permanent structures which may require protection from blast and/or from ballistic projectiles. Examples of such structures include containerized housing units, containerized medical units, containerized mechanical, sanitation, and electrical generation systems, air beam tents, trailer units such as construction trailers, mobile homes used for housing and/or work areas, modular buildings, conventional wood frame structures, and SEAHUTS.

Known wood and wood-based composites structures can perform poorly and unpredictably under blast environments. Accordingly, wood-based construction has not been looked at as a solution in blast environments. Yet, such structures are some of the most cost-effective building materials for a variety of end-uses. Blast mitigating structures typically include expensive materials, such as heavy steel or reinforced concrete components.

In the embodiments described herein below, wood framing members, wood panels, and wood subassemblies are described having improved blast resistance capabilities. An economical coating capable of improving blast resistance by enhancing the component's ductility and energy dissipation capacity is described in detail. The various embodiments are described as comprising wood members. It will be understood however, that sawn lumber, laminated timber, and other wood, wood products, or wood composite materials, such as OSB, may be used.

Under blast bending loads, wood members and assemblies typically fail in a brittle fashion near knots or grain deviations on the tension side (facing away from a blast event) of the member. The ductility enhancing coatings described herein change the brittle failure mode of wood by preventing such tension failures and forcing wood to fail in compression parallel to the grain. When wood fails in this manner, the wood, or wood product's cellular microstructure can absorb a significantly increased amount of energy relative to wood or wood products without the ductility enhancing coating described herein. This increase is due to microbuckling of the wood cell walls in compression, a flexural-compression failure mode that absorbs over five times the energy of a flexural tension failure mode. In other words, the coatings described herein are designed to force the flexural microbuckling of the wood cell structure under blast loads, allowing the otherwise brittle wood to become very ductile.

Previous efforts to strengthen wood construction materials have focused on increasing the strength of wood, but not its ductility. The typical approach has been to use thick reinforcements to increase strength, rather than the relatively thin coatings described herein to increase ductility or energy absorption.

The ductility coatings also protect the wood from moisture absorption, termites, ants, and biodegradation. The coatings can be used to completely encapsulate the wood, thereby providing enhanced protection against insect damage and rot on all surfaces, not just the compression and tension surfaces. Also, thin coatings allow the use of conventional fasteners, and improve the connection of the fasteners.

Buildings and other structures made of subassemblies consisting of coated wood sheathing and coated dimensional lumber such as 2×4s, can absorb up to about 6 to 7 times the energy of a conventionally built wood structure. Individual coated members also are capable of absorbing up to about 6 to 7 times the energy of similar uncoated wood members. Energy absorption, or high ductility, is the key characteristic that allows components, wall assemblies and buildings to resist blast forces and high wind loads. As described herein below, individual components are lightly coated with a thermoplastic or thermoset based composite with suitable reinforcing fibers to impart strength to the outer coating shell. Examples of suitable fibers include E-glass, S-Glass, KEVLAR®, metallic, carbon fiber, SPECTRA® (polyethylene), and other synthetic fibers. If desired, individual components may also receive a reinforcing layer of metal or fibers without a thermoplastic or thermoset resin.

In the embodiments described herein the ductility coating is a fiber reinforced polymer (FRP) coating and comprises a fiber member 200, such as a woven, braided, or non-woven mat or web and a coating material. As shown and described herein, the fiber member 200 is first disposed against one or more sides of a wooden beam 204, 208, 210, 216, 244, and 258 or panel 208, 210, and 216 (each of which will be described in detail below). The wooden beam 204, 208, 210, 216, 244, and 258, or panel 208, 210, and 216 with the desired amount of fiber member 200 applied, is then coated with a thermoplastic or thermoset based material. Suitable coating materials include epoxy vinyl ester resin, polypropylene resin, and polyethylene resin. In the embodiments described herein the fiber member 200 and the coating material combine to define the FRP coating 202. In the illustrated embodiments, a single layer of the FRP coating 202 has a thickness within the range of from about 0.25 mm to about 2.0 mm. Alternatively, the FRP coating 202 may have other thicknesses.

In the exemplary embodiments of the beam 204, 208, 210, 216, 244, and 258 illustrated herein below, the coating is epoxy vinyl ester resin. It will be understood however, that any other desired coating may be applied, such as for example polypropylene resin and polyethylene resin.

In the exemplary embodiments of the panel 208, 210, and 216 illustrated herein below, the coating is polypropylene resin. It will be understood however, that any other desired coating may be applied, such as for example polyethylene resin and epoxy vinyl ester resin.

The fibers within the fiber member 200 may be oriented such that they run with the length of the lumber, i.e., 0 degrees relative to a longitudinal axis of the lumber. If desired, the fibers within the fiber member 200 may be oriented at other angles relative to longitudinal axis of the lumber, such as for example, 0 and 90 degrees, 90 degrees, and ±45 degrees. Depending on the application, the fiber orientation could be varied along the length of the lumber, and the amount of coating could also be varied along the length of the lumber.

Structural building elements or members, such as dimensional lumber or plywood, can be coated using any suitable process, such as painting, spraying, molding, or using a heating/cooling press. A molding process such as Vacuum Assisted Resin Transfer Molding (VARTM), a known process in industry, may also be used. Other application methods may be used to coat the wood, including open mold, rolling, spraying, clamping or pressing, adhesives, and any other type of application method that would allow the coating to bond to the wood. As a pretreatment, the wood may be treated with hydroxymethylated resorcinol (HMR) to improve adhesion. The method of treating wood with HMR as described in U.S. Pat. No. 5,543,487 to Vick et al. is incorporated herein by reference. Other methods of pretreatment can be used to improve adhesion between the wood and the fiber reinforced plastic.

If desired, dyes may be added to the coating material to alter the color of the FRP coating 202. Such dyes may be used for example, to hide the grain of the wood or to allow the coated wood to blend with the environment.

Figure 11:
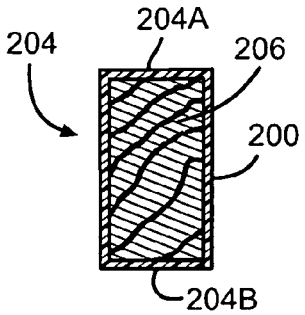
FIG. 11 is a cross sectional end view of a first embodiment of a wooden beam having a ductility enhancing coating.

Referring now to FIG. 11, a first embodiment of a coated wooden beam having a ductility enhancing coating is shown generally at 204. The illustrated beam 204 includes a 2×4 206 wrapped with one layer of the fiber member 200 on each of the four longitudinal sides of the beam 204. The fibers in the fiber member 200 comprise 12 oz/yd$^2$ of E-glass and are oriented at 0 degrees. The amount of fiber in the fiber member 200 mat and the FRP coating 202 may vary. In the illustrated embodiment, the fiber member 200 contains about 0.33 percent fiber by volume. The illustrated fiber member 200 is coated with epoxy vinyl ester resin to define the FRP coating 202.

It will be understood, that when subject to blast loading, the side of the member facing toward the blast will be first subject to compression (this is generally the exterior side of the member), while the side of the member facing away from the blast will be first subject to tension (this is generally the interior side of the member). In the embodiment illustrated in FIG. 11, the compression side of the beam 204 is indicated at 204A and the tension side of the beam 204 is indicated at 204B. It will be understood that wood or wood product beams having other dimensions may be used.

Figure 12:
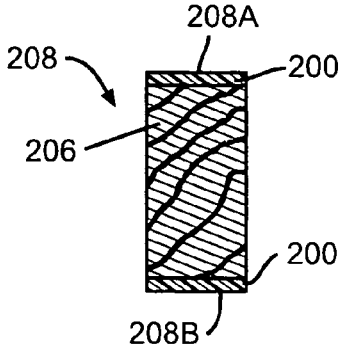
FIG. 12 is a cross sectional end view of a second embodiment of a wooden beam having a ductility enhancing coating.

Referring now to FIG. 12, a second embodiment of a coated wooden beam having a ductility enhancing coating is shown generally at 208. The illustrated beam 208 is substantially identical to the beam 204, but includes the 2×4 206 having one layer of the fiber member 200 on only each of the compression side 208A and the tension side 208B of the beam 208. The beam 208 is otherwise identical to the beam 204.

Figure 13:
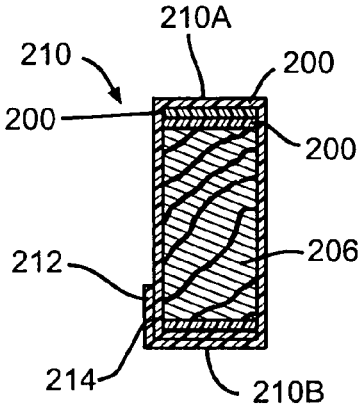
FIG. 13 is a cross sectional end view of a third embodiment of a wooden beam having a ductility enhancing coating.

Referring now to FIG. 13, a third embodiment of a coated wooden beam having a ductility enhancing coating is shown generally at 210. The illustrated beam 210 is substantially identical to the beam 204, but includes the 2×4 206 having 3 layers of the fiber member 200 on each of the compression side 210A and the tension side 210B, and one layer of the fiber member 200 on the wide faces or sides of the beam 210. If desired, the outermost layer of the fiber member 200 may be wrapped about the 2×4 206 such that a trailing portion 212 extends beyond the edge 214, to minimize the occurrence of delamination. In the illustrated embodiment, the fiber member 200 contains about 0.33 percent fiber by volume on the wide faces of the beam 210, and about 1.0 percent on the compression side 210A and the tension side 210B. The beam 210 is otherwise identical to the beam 204.

Figure 14:
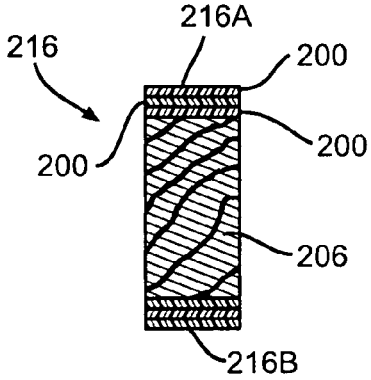
FIG. 14 is a cross sectional end view of a fourth embodiment of a wooden beam having a ductility enhancing coating.

Referring now to FIG. 14, a fourth embodiment of a coated wooden beam having a ductility enhancing coating is shown generally at 216. The illustrated beam 216 is substantially identical to the beam 210, and includes the 2×4 206 having 3 layers of the fiber member 200 on each of the compression side 216A and the tension side 216B, but no fiber member 200 on either of the wide faces of the beam 216. The beam 216 is otherwise identical to the beam 204.

Figure 15:
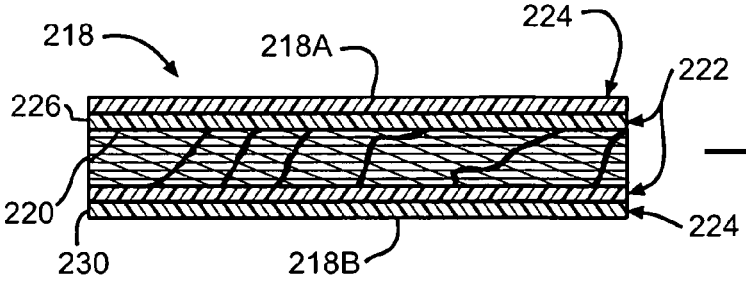
FIG. 15 is a cross sectional view of a portion of a first embodiment of a wooden panel having a ductility enhancing coating.

Referring now to FIG. 15, a first embodiment of a coated wooden panel having a ductility enhancing coating is shown generally at 218. The illustrated panel 218 includes a ⅜ inch plywood panel 220 having one layer of a first FRP coating 222 on each wide face of the panel 220, and one layer of a second FRP coating 224 on each of the layers of the first FRP coating 222. In the illustrated embodiment, the first FRP coating 222 includes a first fiber member 226. The first fiber member 226 has a 70 percent E-glass fiber content by weight and is a 24 to 27 oz/yd$^2$ E-glass with fibers oriented at 0 and 90 degrees in a polypropylene resin. The second FRP coating 228 includes a second fiber member 230. The second fiber member 230 has an 80 percent E-glass fiber content by weight and is a 24 to 27 oz/yd$^2$ E-glass with fibers oriented at 0 and 90 degrees in a polypropylene resin. In the illustrated embodiment, the combined fiber members 226 and 230 contain about 14 percent fiber by volume on both of the compression side 218A and the tension side 218B of the panel 218. It will be understood that other thicknesses of plywood or wood products may be used.

Figure 16:
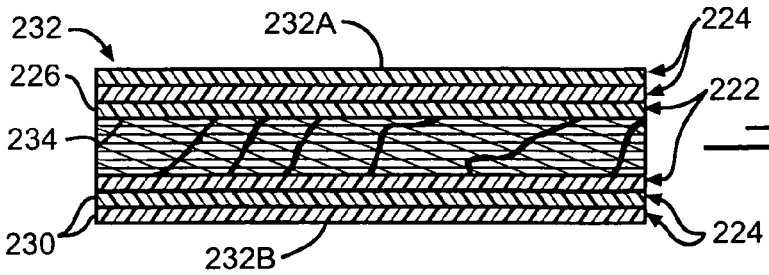
FIG. 16 is a cross sectional view of a portion of a second embodiment of a wooden panel having a ductility enhancing coating.

Referring now to FIG. 16, a second embodiment of a coated wooden panel having a ductility enhancing coating is shown generally at 232. The illustrated panel 232 includes a ½ inch plywood panel 234 having one layer of the first FRP coating 222 on each wide face of the panel 234, and two layers of the second FRP coating 224 on each of the layers of the first FRP coating 222. In the illustrated embodiment, the combined fiber members 226 and 230 contain about 11 percent fiber by volume on both of the compression side 232A and the tension side 232B. It will be understood that other thicknesses of plywood or wood products may be used. The panel 232 is otherwise identical to the panel 218.

Figure 17:
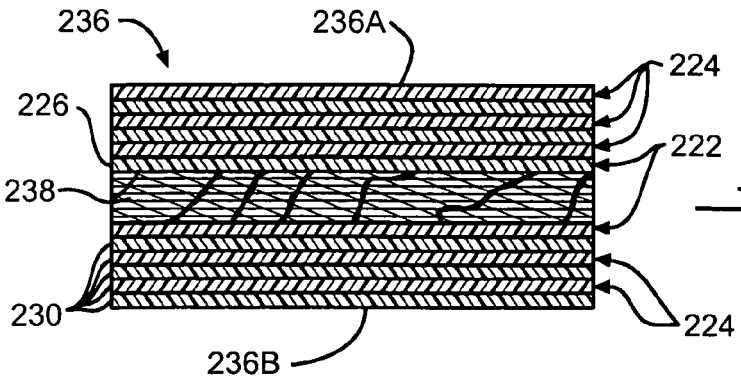
FIG. 17 is a cross sectional view of a portion of a third embodiment of a wooden panel having a ductility enhancing coating.

Referring now to FIG. 17, a third embodiment of a coated wooden panel having a ductility enhancing coating is shown generally at 236. The illustrated panel 236 includes a ¾ inch plywood panel 238 having one layer of the first FRP coating 222 on each wide face of the panel 238, and five layers of the second FRP coating 224 on each of the layers of the first FRP coating 222. In the illustrated embodiment, the combined fiber members 226 and 230 contain about 21 percent fiber by volume on both of the compression side 236A and the tension side 236B. It will be understood that other thicknesses of plywood or wood products may be used. The panel 236 is otherwise identical to the panel 218.

Figure 18:
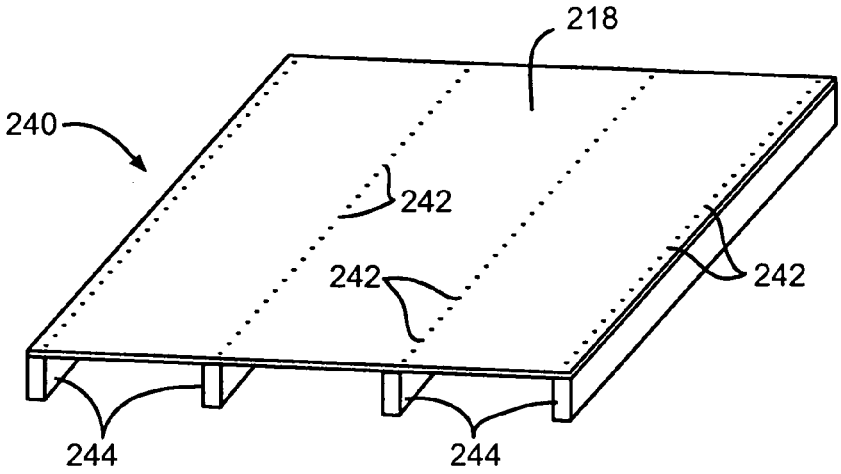
FIG. 18 is a perspective view of a first embodiment of a wall panel assembly.

Referring now to FIG. 18, a first embodiment of a wall panel assembly is shown generally at 240. The wall panel assembly 240 may be referred to a T-panel. The illustrated panel assembly 240 includes a 4 ft×8 ft panel section of the panel 218 illustrated in FIG. 15, and four of the studs or beams 244 illustrated in FIG. 19 spaced 16 inches apart. The panel 218 and studs 244 are fastened together by #8×2.5 inch screws 242 spaced 3 inches apart. It will be understood that the panel assembly 240 may also be used as a floor panel or a ceiling panel, depending on the application.

Figure 19:
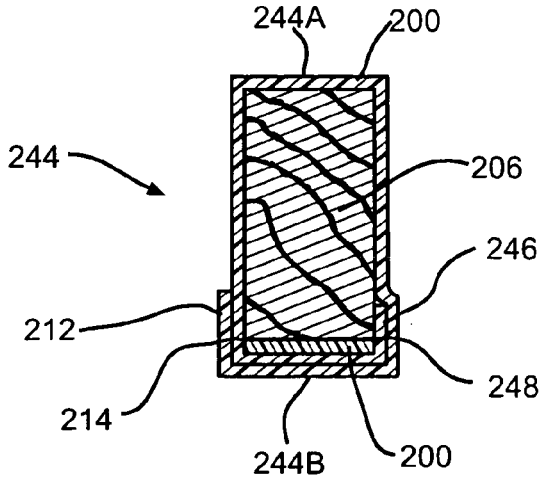
FIG. 19 is a cross sectional end view of a fifth embodiment of a wooden beam having a ductility enhancing coating.

Referring now to FIG. 19, a fifth embodiment of a coated wooden beam having a ductility enhancing coating is shown generally at 244. The illustrated beam 244 is substantially similar to the beam 210, but includes three layers of the fiber member 200 only on the tension side 244B. The illustrated beam 244 includes the outermost layer of the fiber member 200 wrapped about the 2×4 206 such that a leading portion 246 extends beyond an edge 248 and the trailing portion 212 extends beyond the edge 214, to minimize the occurrence of delamination. The beam 244 is otherwise identical to the beam 210.

Figure 20:
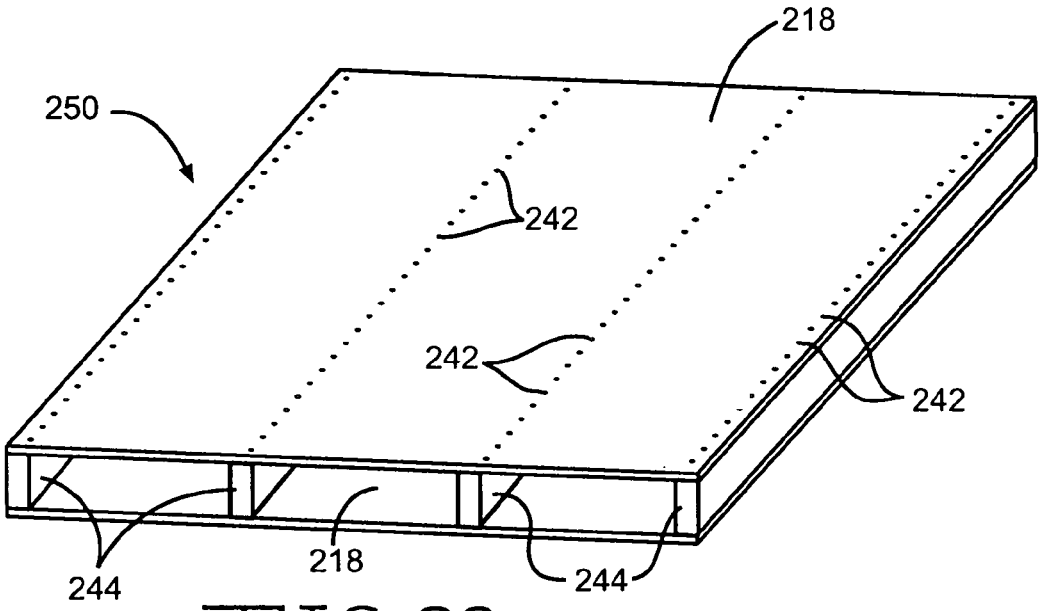
FIG. 20 is a perspective view of a second embodiment of a wall panel assembly.

Referring now to FIG. 20, a second embodiment of a wall panel assembly is shown generally at 250. The wall panel assembly 250 may be referred to an I-panel. The illustrated panel assembly 250 is substantially identical to the panel assembly 240, but includes a second 4 ft×8 ft panel section of the panel 218.

Figure 21:
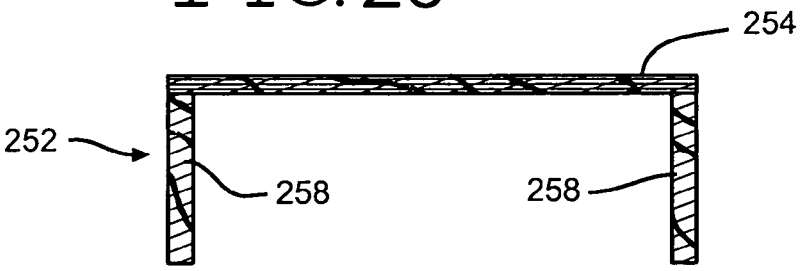
FIG. 21 is an end view of a first embodiment of a roof panel assembly.

Referring now to FIG. 21, a first embodiment of a roof panel assembly is shown generally at 252. The illustrated roof panel assembly 252 includes a 2 ft×14 ft panel section of a ½ inch plywood panel 254 having an FRP coating as shown and described in any of the FIGS. 15 through 17. The roof panel assembly 252 also includes two 2×8 studs or beams 258 illustrated in FIG. 22. The panel 254 and studs 258 are fastened together by the #8×2.5 inch screws 256 (not shown in FIG. 21) spaced 6 inches apart. Alternatively, the roof panel assembly 252 may be formed with a 2 ft×18 ft coated panel section (not shown) and two 2×10 coated studs (not shown). Other suitable arrangements include the use of nails and other fastener spacing schemes.

Figure 22:
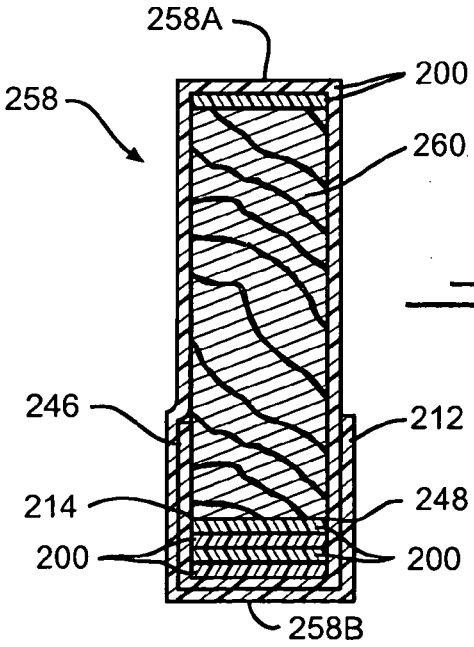
FIG. 22 is a cross sectional end view of a sixth embodiment of a wooden beam having a ductility enhancing coating.

Referring now to FIG. 22, a sixth embodiment of a coated wooden beam having a ductility enhancing coating is shown generally at 258. The illustrated beam 258 includes a 2×8 260 having 2 layers of the fiber member 200 on the compression side 258A and 6 layers of the fiber member 200 on the tension side 258B. A portion of each of the wide faces of the beam 258 has one layer of the fiber member 200, and a portion of each of the wide faces of the beam 258 has two layers of the fiber member 200. In the illustrated embodiment, the outermost layer of the fiber member 200 is wrapped about the 2×8 260 such that a leading portion 246 extends beyond the edge 214 and a trailing portion 212 extends beyond the edge 248, to minimize the occurrence of delamination. In the illustrated embodiment, the fiber member 200 contains about 1.0 percent fiber by volume on the tension side 258B.

Figure 23:
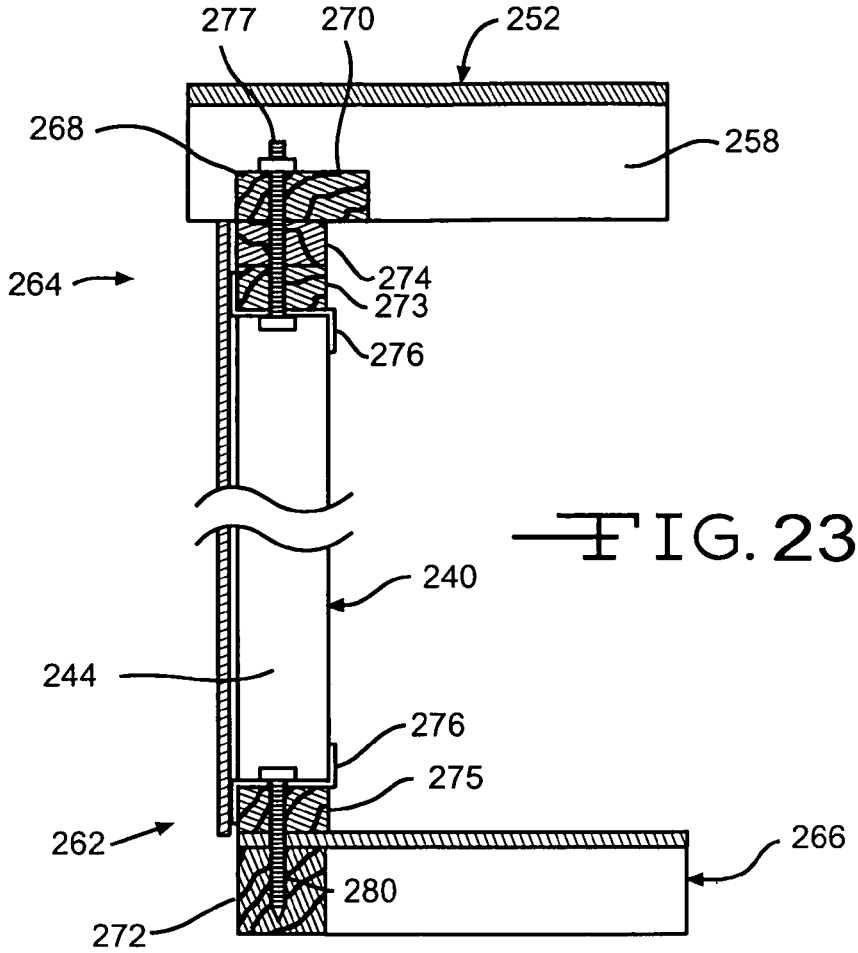
FIG. 23 is a schematic cross sectional view of first embodiments of wall-to-floor and wall-to-roof connections assemblies.
Figure 24:
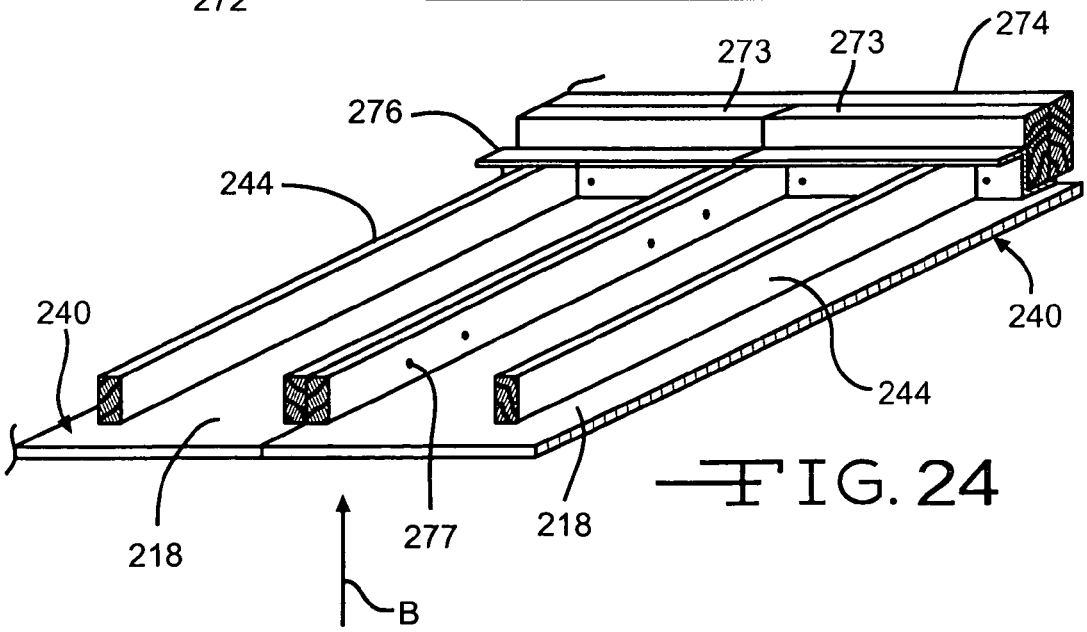
FIG. 24 is a perspective view of a portion of the wall panel assembly illustrated in FIG. 23.

Referring now to FIGS. 23 and 24, first embodiments of wall-to-floor and wall-to-roof connections assemblies, are shown schematically generally at 262 and 264, respectively. In the embodiment illustrated, a floor panel assembly 266, a wall panel assembly 240, and a roof panel assembly 252 are shown. The wall panel assembly 240 includes a top plate 273 and a bottom plate 275. The roof panel assembly 252 includes a 2×6 connector plate or beam 268 mounted transversely to the beams 258 within notches 270 formed in each beam 258. The illustrated floor panel assembly 266 includes a 4×4 plate 272 at one end thereof.

A 2×4 274 is disposed between the wall panel assembly 240 and the roof panel assembly 252 As shown in FIGS. 23 and 24, a bracket having a substantially Z-shaped cross-section is shown generally at 276. A bracket 276 is disposed between the studs 244 and the top and bottom plates 273 and 275. The bracket 276 may be attached to the studs 244 and the top and bottom plates 273 and 275 by any desired means, such as with nails or screws (not shown). In the illustrated embodiment, the bracket 276 is formed from 12 gage steel. It will be understood however, that the bracket 276 may be formed from any other suitable material, such as within the range of from about 18 gage to about 12 gage steel. The connector 400 may also be formed from stainless steel, galvanized steel, or other substantially rigid metals, metal alloys, and non-metals. It will be understood however, that in lieu of the bracket 276, the brackets 400 and 420 illustrated in FIGS. 26 through 28 may be used.

The wall panel assembly 240 is attached to the roof panel assembly 252 with ⅝ inch bolts 277 extending from the wall panel assembly 240 through the bracket 276, the plate 273 and the 2×4 274 through the plate 268. Similarly, the wall panel assembly 240 is attached to the floor panel assembly 266 with ⅝ inch lag screws 280 extending from the wall panel assembly 240 through the bracket 276, the plate 275 and the 2×4 274 into the 4×4 272 of the floor panel assembly 266.

In the illustrated embodiment, four bolts, such as the bolts 277, are used to connect to adjacent wall panel assemblies 240. The bolts 277 are disposed at a distance of about one foot and about two feet from the bottom plate 275 (not shown in FIG. 24 for clarity) and the top plate 273 of the wall panel assemblies 240. Because the illustrated wall panel assemblies 240 have been optimized for one-way bending, that is bending along an axis substantially perpendicular to the longitudinal axis of the studs 244. The bolts 277 are purposely kept away from the mid-span region of the studs 244 to allow as much one-way bending action as possible during a blast, such as a blast in the direction of the arrow B. The illustrated structure further minimizes bending interaction of adjacent panel assemblies 240.

The bracket 276 acts as a continuous top flange joist hanger that transfers load from the studs 244 to the plates 268 and 272. The bolts 277 and lag screws 280 then transfer the load from the plates 268 and 272 to the roof and floor panel assemblies 252 and 266, respectively.

As described above, beams such as the beams 204, 210, 244, and 258, illustrated in FIGS. 11, 13, 19, and 22, respectively, have at least one layer of FRP coating 202 on all four of the long sides. The orientation of the fibers relative to a longitudinal axis of the lumber in each of the beams 204, 210, 244, and 258 may be other than 0 degrees. Table 1 compares the max load, defection at max load, and the energy absorbed for beams having fibers oriented at 0, 90, 0 and 90, and ±45 degrees, and having a different number of layers of FRP coating 202.

TABLE 1

Comparison of Fiber Orientation for 2 × 4's

| Layup | Number of Layers | Max Load (lbs) | Deflection at Max (in) | Energy Absorbed (in-lbs) |
|---|---|---|---|---|
| Control | 0 | 815 | 1.93 | 769 |
| 0 Degree | 1 | 1852 | 4.83 | 12422 |
| | 2 | 2005 | 3.12 | 10151 |
| | 3 | 2232 | 3.69 | 17483 |
| 90 Degree | 1 | 1330 | 3.32 | 5874 |
| | 2 | 1134 | 2.51 | 2454 |
| | 3 | 1313 | 2.28 | 5635 |
| 0 and 90 | 1 | 1576 | 3.13 | 3569 |
| Degree | 2 | 2147 | 5.15 | 10864 |
| | 3 | 2487 | 4.48 | 7676 |
| +−45 | 1 | 1162 | 2.91 | 2954 |
| Degree | 2 | 1922 | 4.41 | 9849 |
| | 3 | 1560 | 3.37 | 6998 |

When subject to blast loading, the side of a wood member oriented toward the blast will be first subject to compression (this is generally the exterior side of the member). The side of the wood member oriented away from the blast will be first subject to tension (this is generally the interior side of the member). As described above, beams such as the beams 208 and 216, illustrated in FIGS. 12 and 14, respectively, have at least one layer of FRP coating 202 on only the compression and tension sides of the beams 208 and 216. Table 2 compares the max load, energy absorbed, load index, and energy index for beams having various combinations of FRP coating 202 on all four of the long sides, and on only the compression (top) and tension (bottom) sides.

TABLE 2

Comparison of 2-sided vs. 4 sided coating on 2 × 4's

| | Max Load (lbs) | Energy Absorbed (in-lbs) | Load Index | Energy Index |
|---|---|---|---|---|
| Control | 981 | 1596 | 1.00 | 1.00 |
| 1 Layer Wrap | 2058 | 6527 | 2.10 | 4.09 |
| 2 Layer Wrap | 2020 | 8340 | 2.06 | 5.23 |
| 3 Layer Wrap | 2433 | 10362 | 2.48 | 6.49 |
| 1 Layer Top & Bottom | 1884 | 5915 | 1.92 | 3.71 |
| 2 Layer Top & Bottom | 2231 | 6904 | 2.27 | 4.33 |
| 3 Layer Top & Bottom | 2396 | 11165 | 2.44 | 7.00 |
| 4 Layer Top & Bottom | 2652 | 11703 | 2.70 | 7.33 |

Advantageously, the FRP coating 202 on the beams illustrated in FIGS. 11 through 14, 19 and 22 allow the wood fibers in the beam to initially fail in compression, thereby allowing a large amount of energy absorption or ductility to occur before eventually failing in tension.

As shown in FIGS. 18, 20, and 21, the wall panel assemblies 240 and 250, and the roof panel assembly 252 may be assembled using the screws 280, or any other suitable method such as nails or adhesive, sufficient to connect the beams to the panels. The panels 218 and 254 may be oriented such that the strength axis is either parallel or perpendicular to the studs. Depending on the application and the ductility required, different fiber orientations may be used as well as varying amounts of the FRP coating 202 on different parts of the assembly.

Sections of the panel assemblies 240, 252, and 266 were tested in 3-point bending and uniform load. The 4×8 ft sections were tested while supported at the 4-foot ends. Supported this way, the sections only bend one-way, that is along the long dimension of the section. The T-panel assembly 240 has more FRP coating 202 on the tension side 240B than on the compression side 240A. The additional FRP coating 202 on the tension side 240B allows the panel assembly 240 to work at an optimized level to maximize ductility. It will be understood that more, less, or equal amounts of FRP coating 202 may be applied to the compression and tension sides 240A and 240B depending on the application. Table 3 compares the max load, load index, energy absorbed, and energy index for panel assemblies having FRP coating 202 and panel assemblies having no FRP coating 202, and having both an I-panel shape and a T-panel shape.

TABLE 3

T & I Assembly 3-Point Bending Results
T-Panels vs. I-Panels

| Coating | Panel Type | Max Load (lbs) | Load Index | Energy Absorbed (in-lbs) | Energy Index |
|---|---|---|---|---|---|
| Studs and Sheathing with no Coating | T | 3279 | 1.00 | 7508 | 1.00 |
| | I | 4823 | 1.47 | 22450 | 2.99 |
| Studs and Sheathing with FRP Coating | T | 7824 | 2.39 | 32688 | 4.35 |
| | I | 9556 | 2.91 | 87630 | 11.67 |

The advantages of high performance coated structural elements are not limited to military applications. Coated lumber elements with enhanced energy-absorbing properties could also be used for protecting or up-armoring government buildings, or in conventional residential or commercial construction for improved earthquake, tornado and hurricane resistance, as well as many other applications where lightweight low-cost structural elements are desirable.

The coated structural elements take advantage of the structural and microstructural response of wood and wood-based composites materials. Coated members described herein have demonstrated up to about 6 to 7 times more energy absorbing capacity than conventional wood and wood-based composites members. The coated members are able to unlock energy that exists inside the wood structure in a manner that has not been accomplished before.

In a hostile environment, troops housed in containerized housing units, such as ISO containers, require both blast and ballistic protection. Like personal protection, but unlike protection for vehicles and stationary structures, weight is an important consideration. The material in panel form must be light enough to be handled by troops without lifting equipment. Unit area cost must be low because the surface area to be covered is large. Installation of up-armoring or blast and ballistic protective materials will typically be done in a field environment where time is of the essence, and installation must be very quick and simple. Also, since the containers are likely to be relocated and transported, it is desirable to have an up-armoring attachment design that allows movement and stacking of the containers without removal of the up-armoring materials.

The up-armoring system must be capable of withstanding blasts according to the Department of Defense Unified Facilities Criteria (UFC) for expeditionary or permanent shelters. The up-armoring material must meet at least NIJ Level IIIA. Mitigation of other threats may also be required and can be accommodated with the embodiments described herein.

Standard ISO containers are not designed to absorb blast loads; their sides will buckle at less than 4 inches deflection. The up-armoring system must reduce the load on the container walls to limit the deflection. The reduced deflection protects occupants from sudden and large pressure changes, and movement of the walls that could cause serious injury from direct contact with the wall or attached furnishings. For example, an occupied bunk attached to a wall could cause serious injury if the unprotected shelter wall is allowed to experience the full impulse of an air blast. The embodiments of a blast mitigation and ballistic protection system for the interior of a structure described herein below provide an advantageous solution to the unique combination of challenging design requirements described above.

Figure 25:
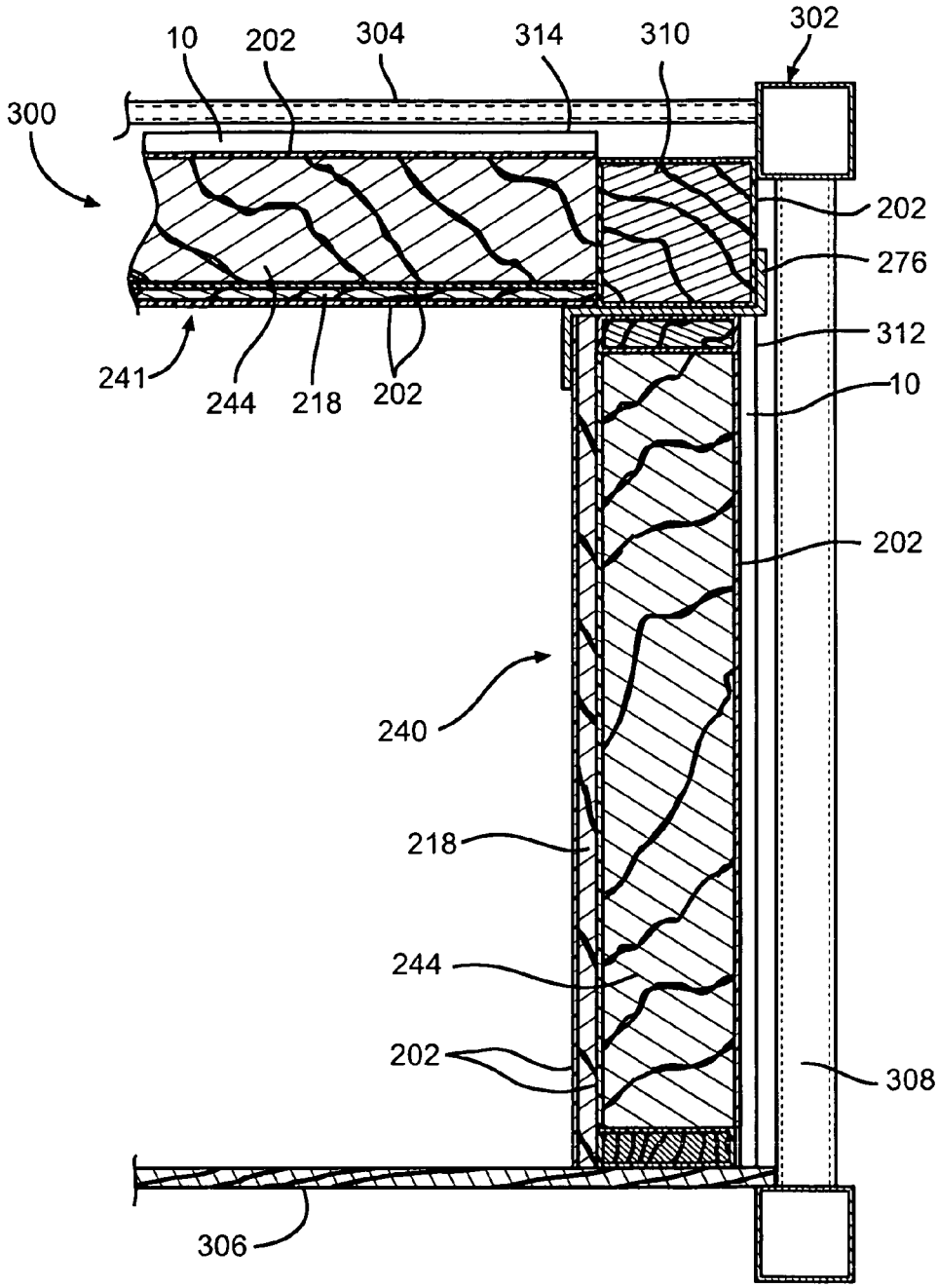
FIG. 25 is a cross sectional side view of a first embodiment of a coated wood and ballistic panel assembly shown inside an International Organization for Standardization (ISO) container.

Referring now to FIG. 25, a first embodiment of a blast mitigation and ballistic protection system for the interior of a structure is shown generally at 300. In the illustrated embodiment, a portion of a standard ISO container 302 is shown. The ISO container 302 includes a roof panel 304, a floor panel 306, and four wall panels 308, only one of which is illustrated in FIG. 25. In the illustrated embodiment, the floor panel 306 is formed from wood or wood composite.

The blast mitigation and ballistic protection system 300 is structured and configured to be mounted within the interior of the ISO container 302 for the protection of personnel and equipment. It will be understood however, that the system 300 may be mounted within any structure wherein blast mitigation and ballistic protection for the protection of personnel and equipment is desired. Examples of other such structures include trailers and thin-walled temporary or semi-permanent buildings.

Importantly for personnel, the blast mitigation and ballistic protection system 300 limits the wall 308 deflection to less than 4 inches under the blast forces described in the UFC.

The illustrated blast mitigation and ballistic protection system 300 includes the wall panel assembly 240. As described in detail above, the wall panel assembly 240 includes the panel 218 illustrated in FIG. 15, and the studs 244 illustrated in FIG. 19. A composite panel 10, illustrated in FIG. 1, is attached to the outwardly facing side (to the right when viewing FIG. 25) of the wall assembly 240. The composite panel 10 may be attached to the studs 244 in the same manner that the panel 218 is attached to the studs 244; i.e., with the screws 242 spaced 3 inches apart.

The blast mitigation and ballistic protection system 300 also includes a roof panel assembly 241. The roof panel assembly 241 is substantially identical to the wall panel assembly 240, and will not be described in detail. A composite panel 10 is also attached to the outwardly facing side (upwardly when viewing FIG. 25) of the wall assembly 241 as described above regarding the wall panel assembly 240. As shown in FIG. 25, the wall panel assembly 240 and the roof panel assembly 241 are disposed adjacent the roof panel 304 and wall panel 308 of the ISO container 302, respectively.

The blast mitigation and ballistic protection system 300 also includes a 4×4 beam 310. The illustrated beam 310 includes the FRP coating 202 such as illustrated in FIG. 11. A bracket 276, as illustrated in FIGS. 23 and 24, is mounted between a first end 312 of the wall panel assembly 240 and the 4×4 beam 310. Although not shown in FIG. 25, a bracket 276 may also be mounted between a first end 314 of the roof panel assembly 241 and the 4×4 beam 310. It will be understood however, that in lieu of the bracket 276, the brackets 400 and 420 illustrated in FIGS. 26 through 28 may be used to attach both the wall panel assembly 240 and the roof panel assembly 241 to the 4×4 beam 310.

In the illustrated embodiment, the interior wall and roof panel assemblies 240 and 241 are assembled with coated wood construction elements; i.e., the panel 218 and the studs 244, each having a layer of FRP coating 202. The outer wall sheathing adjacent to the container wall 308 is made of a composite ballistic panel 10. The coated wood elements described herein resist the splintering of uncoated wood thereby reducing the risk of dislodged pieces becoming lethal projectiles within the shelter.

It will be understood that the blast mitigation and ballistic protection system 300 may be constructed other than as illustrated. For example, the system 300 may include interior wall and roof panel assemblies 240 and 241 formed with any of the beams and panels illustrated in FIGS. 11 through 22, and described in detail herein above.

The system 300 may include interior wall and roof panel assemblies 240 and 241 formed with beams and panels made from engineered lumber products or other wood and non-wood composites. If desired, all of the panels used in the wall and roof panel assemblies 240 and 241 may be the composite ballistic panel 10. Further, other strong, ductile framing members could be used in lieu of coated wood. Uncoated conventional wood framing members could also be used, in which case the sheathing layers, i.e., the panels 218 are the only protective elements. It will be further understood that the blast mitigation and ballistic protection system 300 described herein may be applied to the exterior of a structure such as the ISO container 302.

Traditional stud to plate connectors do not provide resistance to shear and tensile forces developed under large amplitude bending of the studs. Blast loading of wood framed construction creates large amplitude, high strain rate, and positive and negative beam rotation. The embodiments of the connector described in detail herein below provide a solution which will allow framing material to absorb large amounts of energy while resisting uplift, even while the framing material is undergoing large rotations. The embodiments of the connector described herein will also provide protection against high wind loads, preventing the separation of top and bottom plates from studs.

Modification of conventional framing techniques to include high rotation bending member connections will increase the perpendicular load bearing capacity of buildings. This connection will eliminate the traditional end grain fastening which provides little benefit to maintaining the integrity of a building during blast and high wind loading. Accordingly, the construction of wood light-framed buildings that will resist blast and high wind loading requires a high rotation bending connectors, such as described herein, which can be easily and rapidly installed in modular wall systems and site-built stick framed construction.

Figure 26:
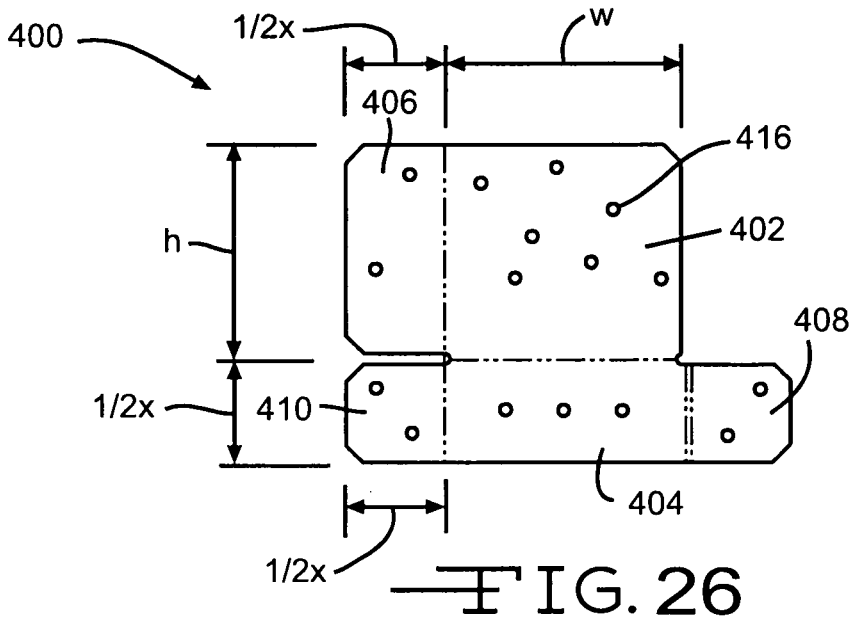
FIG. 26 is a top plan view of a first embodiment of a bracket, shown prior to being folded into its final shape.

Referring now to FIG. 26, a first embodiment of a connector for connecting dimensional lumber or studs to dimensional plates or studs is shown generally at 400.

In the illustrated embodiment, the connector 400 is formed, such as stamped, from light-gauge steel, such as 16-gage steel. It will be understood however, that the connector 400 may be formed from any other suitable material, such as within the range of from about 18 gage to about 12 gage steel. The connector 400 may also be formed from stainless steel, galvanized steel, or other substantially rigid metals, metal alloys, and non-metals.

The first embodiment of the connector 400 includes a first body portion 402 adjacent a second body portion 404. The first body portion 402 has a width w and a height h. In the illustrated embodiment, h=w, although h and w may have any desired dimension and need not be equal. The first body portion 402 includes a leg 406 extending outward (to the left when viewing FIG. 26) of the first body portion 402 at 90 degrees relative to the second body portion 404.

The second body portion 404 has the width w and a height ½w, and includes a first leg 408 and a second leg 410. The second body portion 404 may also have any other desired width and height. The first leg 408 extends outward (to the right when viewing FIG. 26) of the second body portion 404, and the second leg 410 extends outward (to the left when viewing FIG. 26) of the second body portion 404 adjacent the leg 406 of the first body portion 402. The illustrated leg 406 has a width ½w, although the leg 406 may have any desired width. The first and second legs 408 and 410 also have a width ½w and a height ½w. A plurality of fastener apertures 416 are formed in the connector 400 for receiving fasteners (not shown), such as nails or screws.

Figure 27:
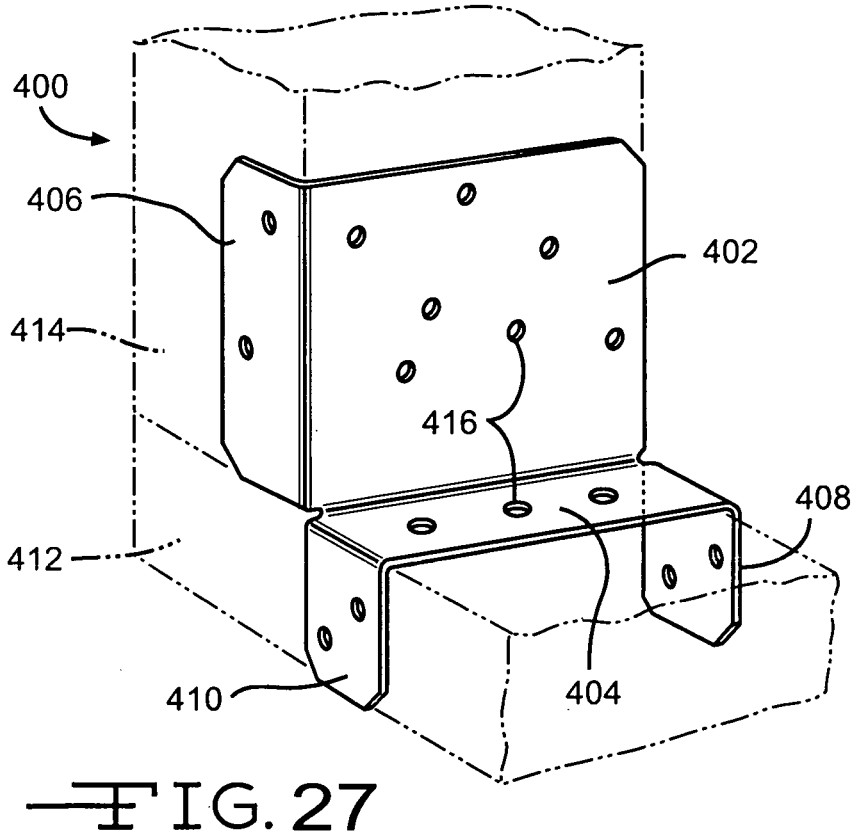
FIG. 27 is a perspective view of the bracket illustrated in FIG. 26, shown fully formed and installed in a wall panel assembly.

As best shown in FIG. 27, the first leg 406 is folded 90 degrees relative to the first body portion 402. The legs 408 and 410 are folded 90 degrees relative to the second body portion 404 and the second body portion 404 is folded 90 degrees relative to the first body portion 402. In the illustrated embodiment, the legs 408 and 410, and the second body portion 404 are attached to a plate 412 (illustrated as a 2×4), and the first body portion 402 and the leg 406 are attached to a stud 414 (illustrated as a 4×4).

Figure 28:
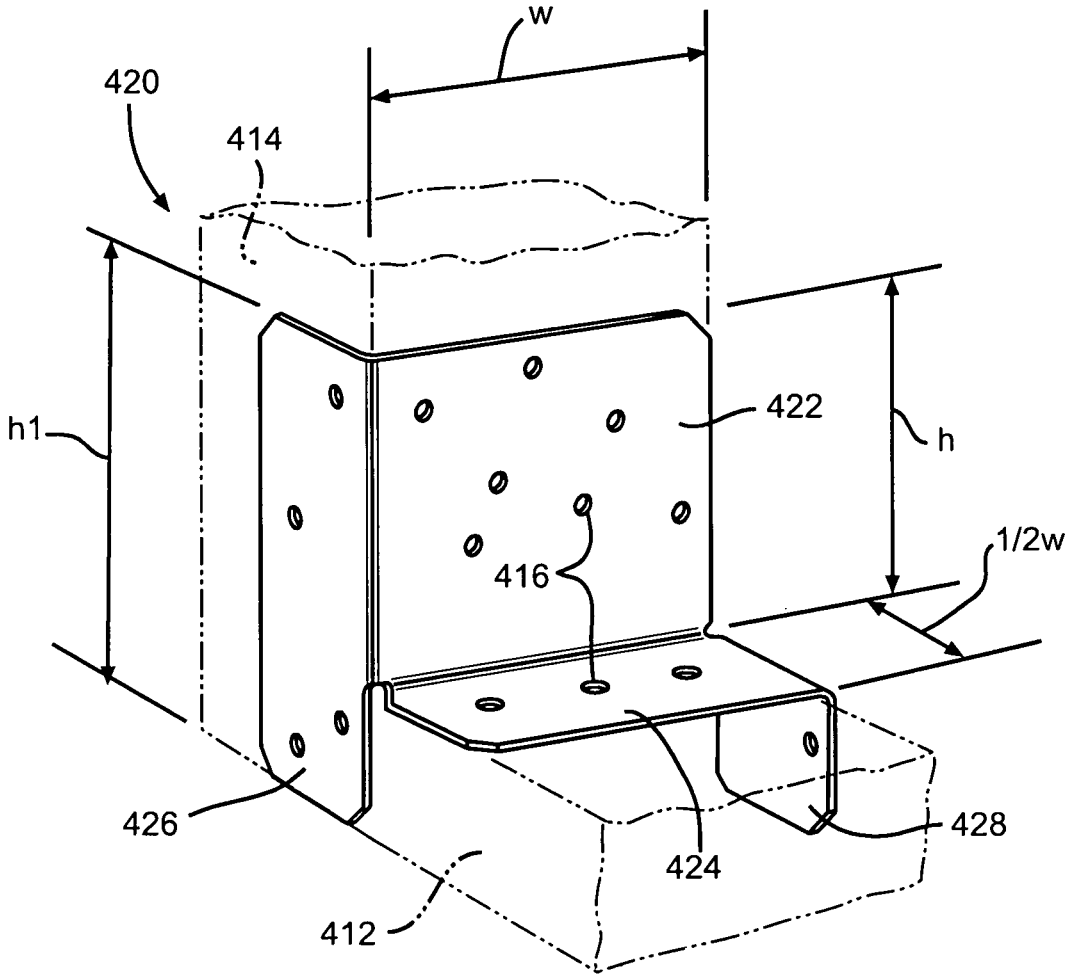
FIG. 28 is a perspective view of a second embodiment of a bracket, shown fully formed and installed in a wall panel assembly.

Referring now to FIG. 28, a second embodiment of a connector for connecting dimensional lumber or studs to dimensional plates or studs is shown generally at 420.

The second embodiment of the connector 420 is substantially similar to the connector 400 and includes a first body portion 422 adjacent a second body portion 424. The first body portion 402 includes a leg 426 extending outward (to the left when viewing FIG. 28) of the first body portion 422. The leg 426 has the width ½w and a height h1 equal to the combined heights of the first body portion 422 and the second body portion 424 (h+½w). The leg 426 may also have any other desired width and height.

The second body portion 424 has the width w and a height ½w, and includes a leg 428. The second body portion 424 may also have any other desired width and height. The leg 428 extends outward (to the right and downwardly when viewing FIG. 28) of the second body portion 424, and is substantially identical to the leg 408 of the connector 400. A plurality of fastener apertures 416 are formed in the connector 420 for receiving fasteners (not shown), such as nails or screws.

As best shown in FIG. 28, the first leg 426 is folded 90 degrees relative to the first body portion 422. The leg 428 is folded 90 degrees relative to the second body portion 424 and the second body portion 424 is folded 90 degrees relative to the first body portion 422. In the illustrated embodiment, the leg 428 and the second body portion 424 are attached to a plate 412, and the first body portion 422 and the leg 426 are attached to the stud 414.

Advantageously, the connectors 400 and 420 will minimize the danger presented to troops from dislodged framing material and debris resulting from the forces generated during explosions. Additionally, the connectors 400 and 420 are easily adapted to conventional framing techniques and high energy absorbing modular panel construction. The connectors 400 and 420 further eliminate ineffective end grain nailing, increase ductility of framing connection points, prevent wall studs from twisting, provide resistance to loads in three orthogonal directions, provide stability at connection points of wall framing during the positive and negative phases of a blast wave, will yield and absorb energy during high pressure loading of wall assemblies, and will aid in maintaining dimensional stability during shipping and handling of building components.

The principle and mode of operation of the blast mitigation and ballistic protection system have been described in its preferred embodiment. However, it should be noted that the blast mitigation and ballistic protection system described herein may be practiced otherwise than as specifically illustrated and described without departing from its scope.

What is claimed is:

1. A blast and ballistic protective wall panel assembly comprising:

a plurality of panel members, each having two major faces;

wherein an interior major face defines a tension side of the first panel;

wherein an exterior major face defines a compression side of the first panel; and wherein at least the tension side of the first panel member is substantially covered by fiber reinforced polymer (FRP); and a structural frame member having a substantially rectangular transverse cross-section with a compression side, a tension side, and two lateral sides, at least the tension side of the structural frame member being substantially covered by FRP;

wherein the structural frame member extends from a first one of the panel members to a second one of the panel members such that the tension side of the structural frame member is connected to the compression side of the first one of the panel members, and the compression side of the structural frame member is connected to the tension side of the second one of the panel members, thereby defining a blast and ballistic protective wall panel assembly.

2. A blast and ballistic protective wall panel assembly comprising:

a first panel member defining an interior wall member and having two major faces;

wherein an interior major face defines a tension side of the first panel;

wherein an exterior major face defines a compression side of the first panel; and wherein at least the tension side of the first panel member is substantially covered by fiber reinforced polymer (FRP);

a structural frame member having a substantially rectangular transverse cross-section with a compression side, a tension side, and two lateral sides, at least the tension side of the structural frame member being substantially covered by FRP and a second composite panel member defining an exterior wall member, including:

a first composite layer;

a second composite layer;

a core disposed between the first and second composite layers, the core formed from one of wood and a wood product; and an encapsulation layer covering all exposed surfaces of the second composite panel member;

wherein the structural frame member extends from the first panel member to the second composite panel member such that the compression side of the first panel member is connected to the tension side of the structural fame member and the second composite panel member is connected to the compression side of the structural frame member.

3. The blast and ballistic protective wall panel assembly according to claim 2, further including a plurality of structural frame members.

4. The blast and ballistic protective wall panel assembly according to claim 2, wherein the tension side and the compression side of the first panel member are substantially covered by FRP.

5. The blast and ballistic protective wall panel assembly according to claim 2, wherein the tension side and the compression side of the structural frame member are substantially covered by FRP.

* * * * *

UNITED STATES PATENT AND TRADEMARK OFFICE

CERTIFICATE OF CORRECTION

PATENT NO. : 8,596,018 B2
APPLICATION NO. : 12/244407
DATED : December 3, 2013
INVENTOR(S) : Dagher et al.

It is certified that error appears in the above-identified patent and that said Letters Patent is hereby corrected as shown below:

In the Claim

Column 22, Claim 2, Line 32, delete “fame” and insert --frame--.

Signed and Sealed this
Fourth Day of February, 2014

Michelle K. Lee

Michelle K. Lee
*Deputy Director of the United States Patent and Trademark Office*